US009509074B2

(12) United States Patent
Otsuta

(10) Patent No.: US 9,509,074 B2
(45) Date of Patent: Nov. 29, 2016

(54) MULTIPLE WIRE TERMINAL CONNECTING STRUCTURE

(71) Applicant: Yazaki Corporation, Minato-ku, Tokyo (JP)

(72) Inventor: Yasuhiro Otsuta, Kakegawa (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/921,286

(22) Filed: Oct. 23, 2015

(65) Prior Publication Data

US 2016/0043491 A1 Feb. 11, 2016

Related U.S. Application Data

(63) Continuation of application No. PCT/JP2014/061639, filed on Apr. 24, 2014.

(30) Foreign Application Priority Data

Apr. 26, 2013 (JP) ..... 2013-094595

(51) Int. Cl.
*H01R 13/26* (2006.01)
*H01R 13/6583* (2011.01)
(Continued)

(52) U.S. Cl.
CPC ..... *H01R 13/26* (2013.01); *H01R 13/04* (2013.01); *H01R 13/5208* (2013.01);
(Continued)

(58) Field of Classification Search
CPC ..... H01R 13/6583; H01R 13/6585; H01R 24/86; H01R 2103/00; H01R 13/26; H01R 13/5219; H01R 13/6596; H01R 13/04; H01R 13/5208
USPC ..... 439/692, 166, 174, 660, 350, 357, 496
See application file for complete search history.

(56) References Cited

U.S. PATENT DOCUMENTS 3,414,869 A * 12/1968 Pascua ..... G01R 1/0433 174/138 G
3,980,380 A * 9/1976 Cieniawa ..... H01R 4/2429 439/404

(Continued)

FOREIGN PATENT DOCUMENTS

JP S62-176075 A 8/1987
JP H08-007989 A 1/1996

(Continued)

OTHER PUBLICATIONS

Jul. 29, 2014—(WO) Written Opinion—PCT/JP2014/061639.

(Continued)

*Primary Examiner* — Edwin A. Leon
(74) *Attorney, Agent, or Firm* — Banner & Witcoff, Ltd.

(57) ABSTRACT

Each terminal has a connection portion to be connected to a portion of a corresponding one of the electric wires from which an insulation coating is stripped off such that a core wire is exposed, and an extension portion extending from the connection portion and to be connected to a terminal member of a counterpart connection device. The extension portions are each formed to have a cross section of an arc shape and are arranged such that the cross sections are arranged in a substantially circular manner and such that the extension portions are spaced from each other in a circumferential direction.

4 Claims, 18 Drawing Sheets

(51) Int. Cl.

| | |
|---|---|
| ***H01R 13/6585*** | (2011.01) |
| ***H01R 24/86*** | (2011.01) |
| ***H01R 13/52*** | (2006.01) |
| ***H01R 13/6596*** | (2011.01) |
| ***H01R 13/04*** | (2006.01) |
| *H01R 103/00* | (2006.01) |

(52) U.S. Cl.
CPC ..... *H01R 13/5219* (2013.01); *H01R 13/6583* (2013.01); *H01R 13/6585* (2013.01); *H01R 13/6596* (2013.01); *H01R 24/86* (2013.01); *H01R 2103/00* (2013.01)

(56) References Cited

U.S. PATENT DOCUMENTS

| | | | | |
|---|---|---|---|---|
| 4,770,644 A | | 9/1988 | Feder | |
| 5,871,371 A | * | 2/1999 | Rothenberger ..... | H01R 9/038 439/579 |
| 6,010,369 A | | 1/2000 | Itabashi et al. | |

FOREIGN PATENT DOCUMENTS

| | | | |
|---|---|---|---|
| JP | H09-035825 | A | 2/1997 |
| JP | H09-219264 | A | 8/1997 |
| JP | 2010-272404 | A | 12/2010 |
| JP | 2011-081957 | A | 4/2011 |
| JP | 2012-238500 | A | 12/2012 |

OTHER PUBLICATIONS

Jul. 29, 2014—International Search Report—Intl App PCT/JP2014/061639.
Aug. 30, 2016—(JP) Notification of Reasons for Refusal—App 2013-094595.

* cited by examiner

MULTIPLE WIRE TERMINAL CONNECTING STRUCTURE

CROSS REFERENCE TO RELATED APPLICATIONS

This application is a continuation of International Patent Application No. PCT/JP2014/061639 filed on Apr. 24, 2014, claiming priority from Japanese Patent Application No. 2013-094595 filed on Apr. 26, 2013, the contents of which are incorporated herein by reference.

FIELD OF INVENTION

The present invention relates to a structure for connecting terminals to a plurality of electric wires, core wires of which are each coated with an insulation coating.

BACKGROUND ART

Cables having a plurality of electric wires, core wires of which being each coated with an insulation coating, are arranged in vehicles such as automobiles (see Patent Document 1). Each electric wire is connected to, for example, a terminal, a circuit or an electric wire of a counterpart connection device in a state of contacting an outer housing or the like of the counterpart connection device in a shielded manner. The shielding of the electric wires can be performed collectively by, for example, providing the respective end portions of the plurality of electric wires with terminals for connection to the counterpart connection device and by covering the connection portions of these terminals with a single shield conductor.

Patent Document 1: JP2011-81957A

When the terminals are connected to the respective end portions of the plurality of electric wires and the electric wires are connected via the terminals to terminals or the like of the counterpart connection device, the multiple terminals are arranged at a section where the electric wires are connected to the terminals. In the terminal connection structure disclosed in Patent Document 1, a flat plate terminal is connected to each of the end portions of three electric wires disposed in parallel. That is, three terminals are arranged in parallel at the section where the three electric wires are connected to the terminals, and these terminals are opposed to the terminals or the like of the counterpart connection device. Hence, the size of the section where the plurality of electric wires are connected to the terminals becomes large in the arrangement direction of the terminals in accordance with the number of the terminals, and this causes a problem in saving space for the terminal connection structure of the electric wires. In addition, as in the case of the section where the electric wires are connected to the terminals, the size of the terminal connection section of the counterpart connection device also becomes large. Thus, to save the space for the terminal connection structure, it is necessary to consider the terminal connection structure of the counterpart connection device.

SUMMARY OF INVENTION

The present invention has been made in view of these circumstances, and it is an object thereof to reduce a size of a section where a plurality of electric wires are connected to the terminals.

According to an aspect of the present invention, a connection structure is provided for a plurality of electric wires, each having a core wire coated with an insulation coating, and a plurality of terminals connected to the electric wires respectively. Each of the terminals has a connection portion to be connected to a portion of a corresponding one of the electric wires from which the insulation coating is stripped off such that the core wire is exposed and an extension portion extending from the connection portion to be connected to a terminal member of a counterpart connection device. The extension portions are each formed to have a cross section of an arc shape, and are arranged such that the cross sections of the extension portions are arranged in a substantially circular manner and such that the extension portions are spaced from each other in a circumferential direction.

With this configuration, the plurality of terminals can be coaxially arranged in a separated manner. In addition, because the extension portions of the plurality of terminals are each formed to have a cross section of an arc shape and the extension portions are arranged in a substantially circular manner (that is, opposed to each other to form a substantially cylindrical shape), each terminal need not be formed into a cylindrical shape, so that the configuration of the terminals can be simplified and the processing cost thereof can be reduced.

In this case, the multiple wire terminal connection structure may further include a plurality of spring parts configured to contact the extension portions and the terminal members such that the extension portions and the terminal members are electrically connected to each other, the plurality of spring parts being each extended to have a cross section of an arc shape and are arranged such that the cross sections of the spring parts are arranged in a substantially circular manner and such that the spring parts are spaced from each other in the circumferential direction.

In this multiple wire terminal connection structure, the terminals may be arranged such that the axial centers of the arc shapes of the extension portions extend along a direction in which the electric wires extend, or such that the axial centers of the arc shapes of the extension portions extend along a direction intersecting the direction in which the electric wires extend. For example, in the case in which the respective terminals are arranged such that the axial centers of the arc shapes of the extension portions extend along a direction intersecting the direction in which the electric wires extend, the multiple wire terminal connection structure may include a sealing member configured to hermetically enclose the terminals from the outside, wherein the sealing member has a bottom part and a lid part that are arranged in front and back in the intersecting direction, and the bottom part and the lid part are assembled together to form a unitary body.

With the present invention, the size of the section where the plurality of electric wires are connected to the terminals can be reduced.

BRIEF DESCRIPTION OF THE DRAWINGS

FIGS. 2A and 2B are perspective views illustrating the overall multiple wire terminal connection structure according to the first embodiment of the present invention, in which FIG. 2A is a perspective view illustrating a state in which the components shown in FIG. 1 are assembled, viewed from the terminal side, and FIG. 2B is a perspective view illustrating a state in which the components are assembled, viewed from the side opposite to that shown in FIG. 2A.

FIGS. 6A and 6B are perspective views illustrating the entire structure of the terminal members (terminal base) of the counterpart connection device according to the first embodiment of the present invention, in which FIG. 6A is a perspective view illustrating a state in which the components shown in FIG. 5 are assembled, viewed from the terminal side, and FIG. 6B is a perspective view illustrating a state in which the components are assembled, viewed from the side opposite to that shown in FIG. 6A.

FIGS. 8A and 8B are perspective views illustrating the overall multiple wire terminal connection structure according to the second embodiment of the present invention, in which FIG. 8A is a perspective view illustrating a state in which the components shown in FIG. 7 are assembled, viewed from the terminal side, and FIG. 8B is a perspective view illustrating a state in which the components are assembled, viewed from the side opposite to that shown in FIG. 8A.

FIGS. 13A and 13B are perspective views illustrating the entire structure of the terminal members (terminal base) of the counterpart connection device according to the second embodiment of the present invention, in which FIG. 13A is a perspective view illustrating a state in which the components shown in FIG. 12 are assembled, viewed from the terminal side, and FIG. 13B is a perspective view illustrating a state in which the components are assembled, viewed from the side opposite to that shown in FIG. 13A.

FIGS. 15A and 15B are perspective views illustrating the overall multiple wire terminal connection structure according to the third embodiment of the present invention, in which FIG. 15A is a perspective view illustrating a state in which the components shown in FIG. 14 are assembled, viewed from the terminal side, and FIG. 15B is a perspective view illustrating a state in which the components are assembled, viewed from the side opposite to that shown in FIG. 15A.

EMBODIMENTS OF INVENTION

A multiple wire terminal connection structure (hereafter simply referred to as a connection structure) according to the present invention will be described below referring to the accompanying drawings. The present invention relates to the connection structure of the connection between a plurality of electric wires, the core wires of which are each coated with an insulation coating, and a plurality of terminals to be connected to the electric wires, and the connection structure can be applied, for example, as the connection structure of a cab tire cable or the like in which power supply wires and signal wires are coated with insulators and the insulators are protected using a sheath.

First Embodiment

Figure 1:
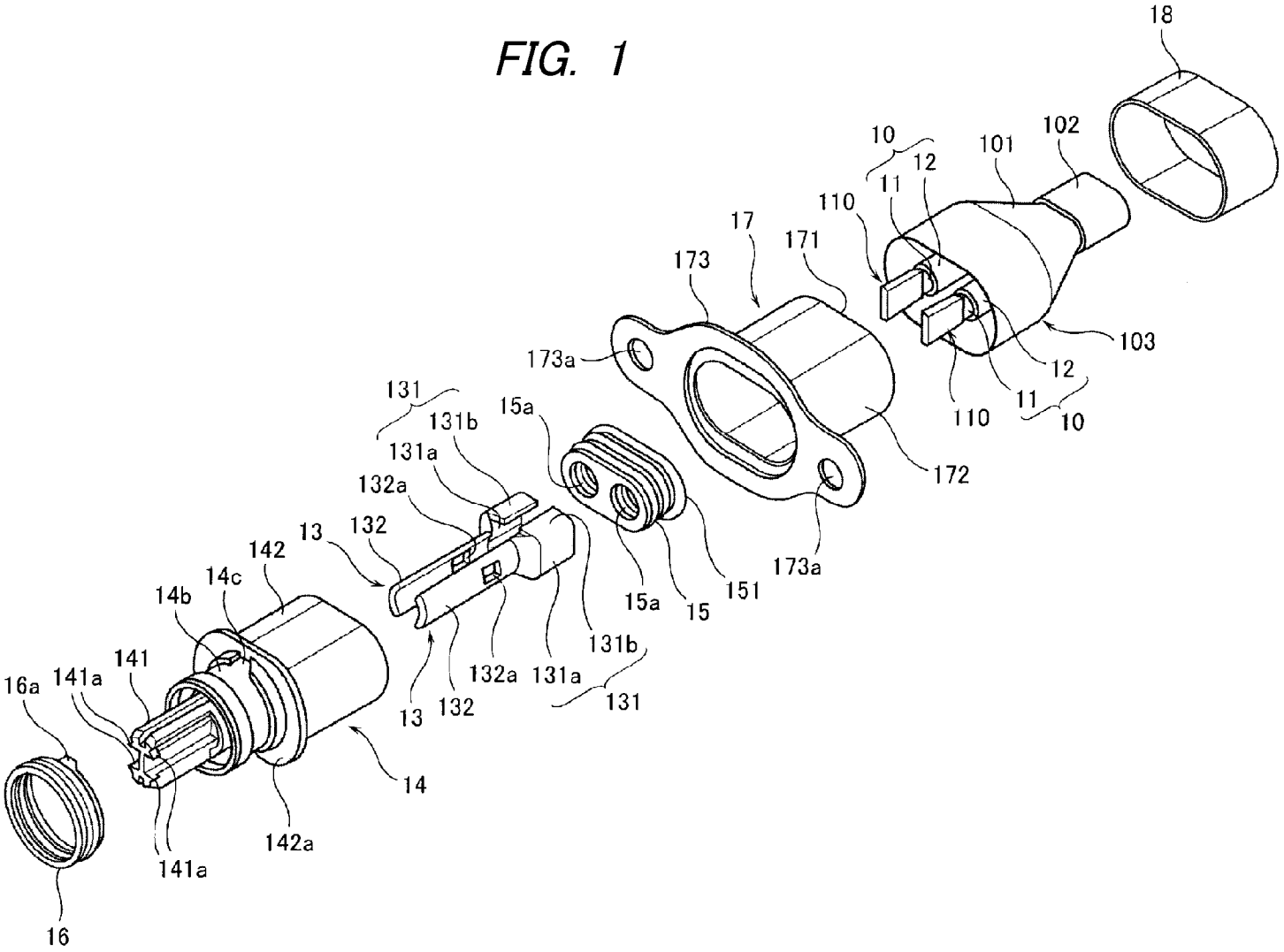
FIG. 1 is a perspective view of a multiple wire terminal connection structure according to a first embodiment of the present invention with the components thereof being disassembled.
Figure 2A:
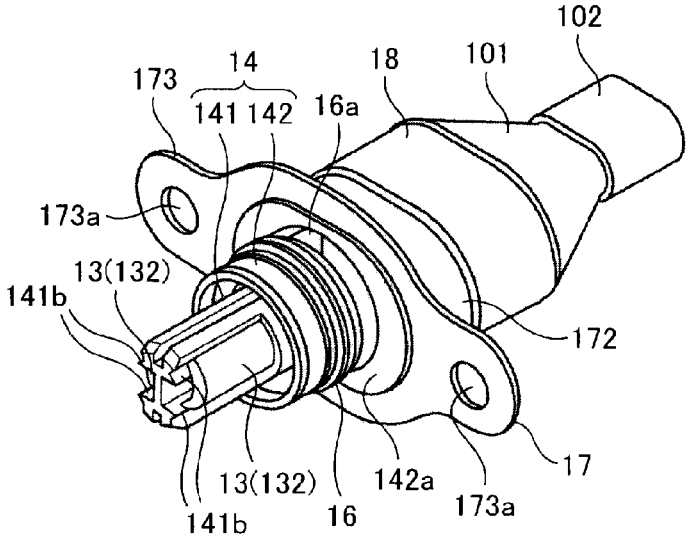
Figure 2B:
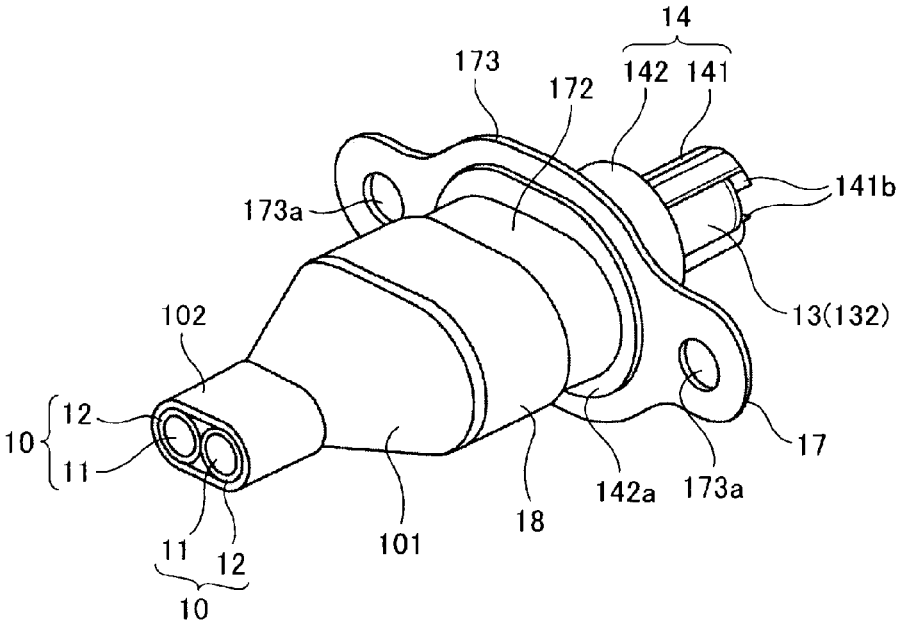
Figure 3:
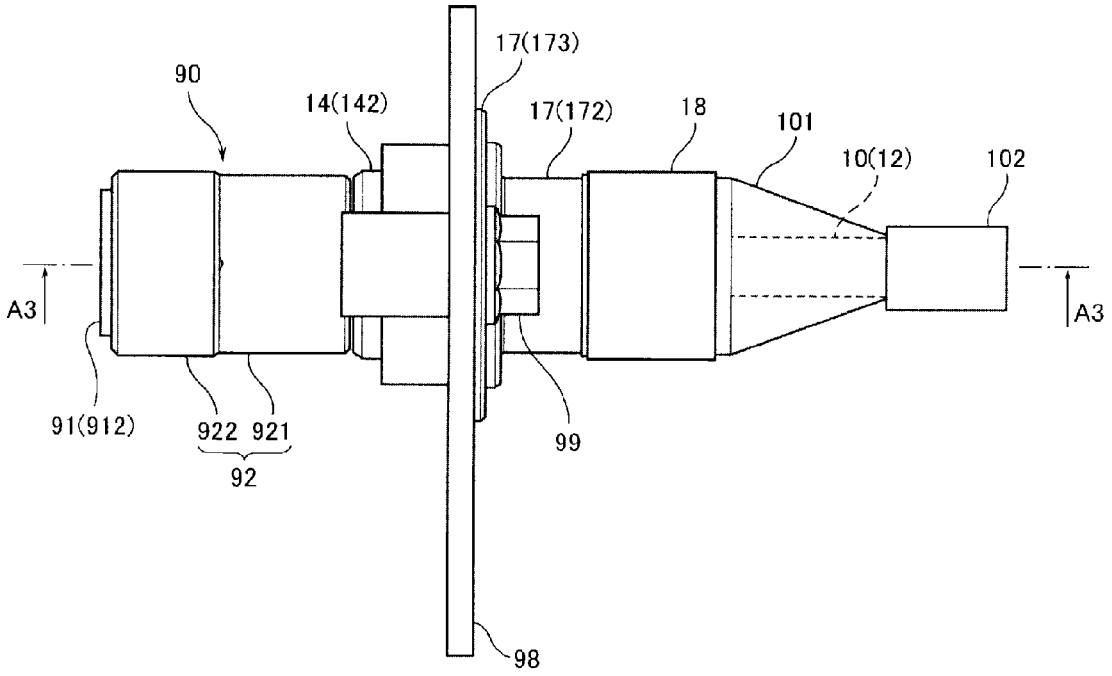
FIG. 3 is a plan view illustrating a state in which the multiple wire terminal connection structure according to the first embodiment of the present invention is fixed to a counterpart connection device.
Figure 4:
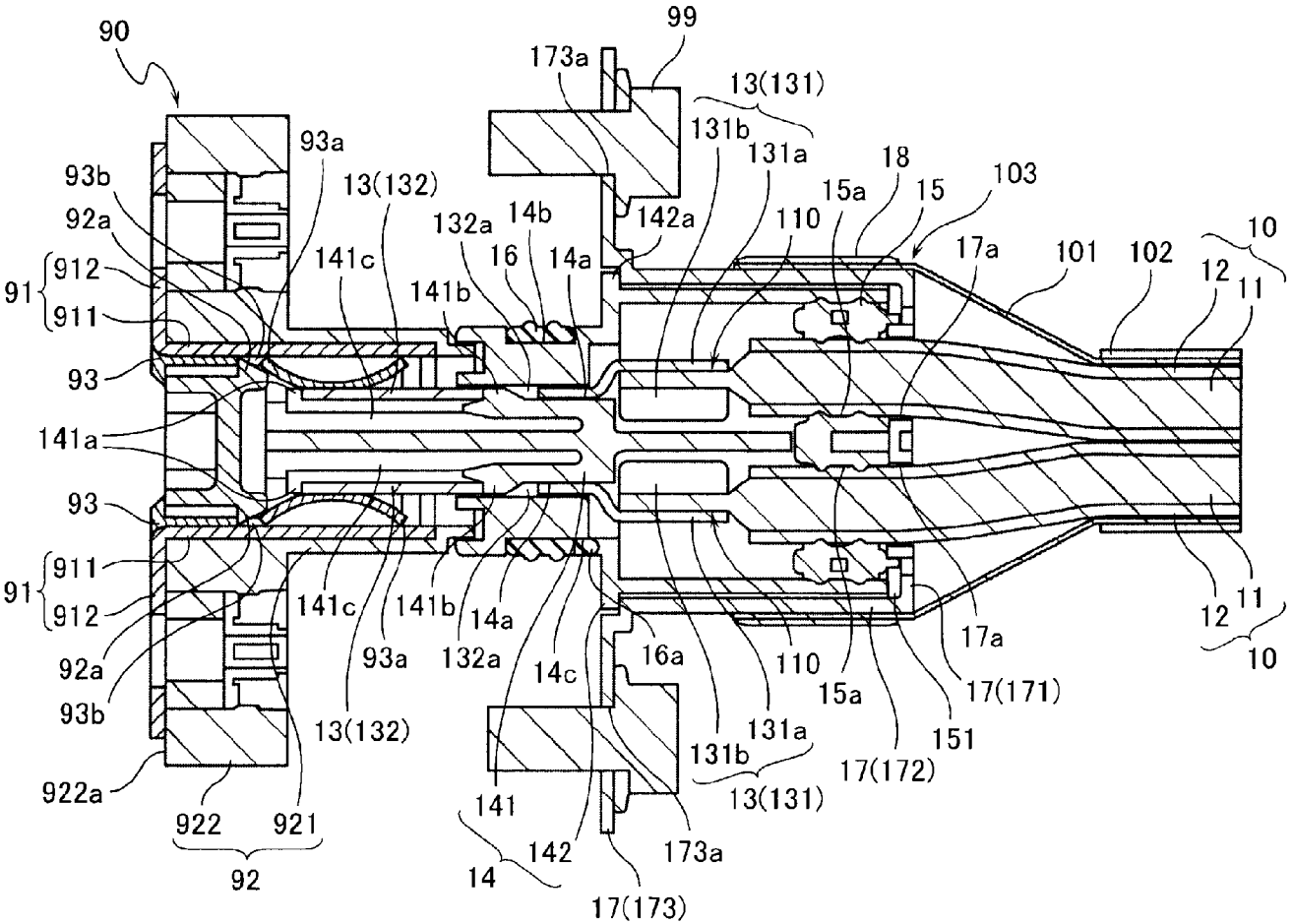
FIG. 4 is a longitudinal sectional view taken along the arrows A3 in FIG. 3, and viewed from the direction of the arrows.

FIGS. 1 to 4 illustrate a connection structure according to a first embodiment of the present invention. FIG. 1 is a perspective view illustrating the connection structure with the components thereof disassembled. FIGS. 2A and 2B are perspective views of the overall connection structure, FIG. 2A is a perspective view illustrating a state in which the components shown in FIG. 1 are assembled, viewed from the terminal side, and FIG. 2B is a perspective view illustrating a state in which the components are assembled, viewed from the side opposite to that shown in FIG. 2A. FIG. 3 is a plan view illustrating a state in which the connection structure is fixed to a counterpart connection device, and FIG. 4 is a longitudinal sectional view taken along the arrows A3 in FIG. 3, and viewed from the direction of the arrows.

As shown in FIGS. 1 to 4, in this embodiment, two terminals 13 are connected to two electric wires 10, the core wires 11 of which being each coated with an insulation coating 12, and each terminal being connected to a corresponding one of the electric wires. These two electric wires 10 are surrounded by a single shield conductor (e.g., a braided wire) 101 coated with a protection sheath 102 and a section where the electric wires 10 and the terminals 13 (hereafter, the section where the electric wires 10 are connected to the terminals) are connected to each other is shielded collectively with the shield conductor 101. In the following descriptions, with respect to the extension direction (the left-right direction in FIG. 4) of the electric wire 10, the side (the left side in FIG. 4) to which the terminal 13 is connected is referred to as a terminal side, and the opposite side (the right side in FIG. 4) thereof is referred to as a base end side.

Each terminal 13, formed of a plate material having conductivity, has a connection portion 131 that is connected to a portion (hereafter, a end portion) 110 from which the insulation coating 12 is stripped off such that the core wire 11 is exposed and an extension portion 132 that is extended from the connection portion 131 and connected to one of a plurality of terminal members (the terminal base terminals 91 of a terminal base 90 to be described later) provided in a counterpart connection device (e.g., an electric component mounted on an automobile) to be connected to the electric wires 10. Each extension portion 132 is formed to have a cross section of an arc shape, and the terminals 13 are arranged such that the cross sections of the extension portions 132 are arranged in a substantially circular manner and such that the extension portions 132 are spaced from each other in the circumferential direction. That is, the extension portions 132 of the terminals 13 are opposed to each other to form a substantially cylindrical shape such that that the axial centers of the extension portions 132 are coaxially arranged. With this configuration, the size of the section where the electric wires 10 are connected to the terminals is not required to be enlarged in the arrangement direction of the terminals, for example, unlike the case in which two flat plate terminals (flat tabs) or bar-shaped terminals (round pins) are arranged in parallel. In addition, the terminals 13 are not required to be formed into a cylindrical shape or the like and the configuration thereof can be simplified, whereby the processing cost thereof can be reduced.

The connection portion 131 has a flat plate portion 131*a* extending along the end portion 110 of the core wire 11 and a wall portion 131*b* provided to extend from the flat plate portion 131*a*, the wall portions 131*b* of the connection portions 131 being opposed to each other. The flat plate portion 131*a* is joined to the end portion 110 by ultrasonic welding or the like, and the wall portion 131*b* clamps and holds the end portion 110 to which the flat plate portion 131*a* is joined. With this configuration, the terminal 13 is integrated with the electric wire 10 while being connected to the core wire 11. The extension portions 132 may be extended in an arc shape from the connection portions 131, for example, in this embodiment, the extension portions are configured so as to be extended in a substantially semi-cylindrical shape so as to have the same curvature. Hence, in the case that the extension portions 132 of the two terminals 13 are disposed coaxially, they can be opposed to each other as one set and formed into a substantially cylindrical shape.

The two terminals 13 disposed as described above are accommodated in a housing member (hereafter, a terminal housing) 14 so as to be separated from each other and so that the axial centers of the substantially semi-cylindrical shapes thereof are coaxial. The terminal housing 14 has a terminal holding portion 141 configured to hold the two terminals 13 from the inner peripheral side thereof and a terminal accommodating portion 142 configured to surround the outer peripheral sides of the terminals 13 (in other words, the section where the electric wires 10 are connected to the terminals) held by the terminal holding portion 141. The terminal housing 14 has an opening section (hereafter, a housing opening) 14*a* in which the terminal holding portion 141 and the terminal accommodating portion 142 allow the extension portions 132 of the two terminals 13 to be exposed to the outside. The terminal holding portion 141 and the terminal accommodating portion 142 are substantially circular as viewed from the distal end sides of the terminals 13 and are disposed coaxially with the axial centers of the substantially semi-cylindrical shapes of the extension portions 132.

The terminal holding portion 141 holds the extension portions 132 having been inserted into the housing opening 14*a* and exposed to the outside in the extension direction thereof. As a result, the extension portions 132 are positioned so as to be connectable to the terminal members of the counterpart connection device. The terminal holding portion 141 is provided with positioning protrusions 141*a* at the positions of the distal end portions of the extension portions 132 in the extension direction thereof and is also provided with engaging protrusions 141*b* on the front side of the positioning protrusions 141*a*. The positioning protrusions 141*a* and the engaging protrusions 141*b* are provided so as to protrude on a flexible arm extending in a cantilever shape along release grooves (hereafter, housing grooves) 141*c*.

When the terminals 13 are accommodated in the terminal housing 14, the engaging protrusions 141*b* are moved to the opening sections (hereafter, terminal opening sections) 132*a* formed in the extension portions 132 along the inner peripheral faces of the extension portions 132 while contacting the inner peripheral faces of the extension portions 132 and being elastically bent and deformed so as to be toppled toward the housing grooves 141*c*. When the engaging protrusions 141*b* have been moved to the terminal opening sections 132*a*, the engaging protrusions 141*b* are elastically bent and deformed to return to the original shape thereof so as to be widened outward (in a diameter expanding direction) and then engaged with the terminal opening sections 132*a*. The positioning protrusions 141*a* serve as the positioning stoppers for the extension portions 132 having been inserted into the housing opening 14*a*. Hence, when the terminals 13 are accommodated in the terminal housing 14, the extension portions 132 can be positioned in a state of being properly exposed from the housing opening 14*a* by sliding the extension portions 132 along the terminal holding portion 141 until they contact the positioning protrusions 141*a*. In this case, after elastically bent and deformed together with the engaging protrusions 141*b*, the positioning protrusions 141*a* being in a state of having been elastically bent and deformed and then returned to the original shape thereof simultaneously with the engaging protrusions 141*b* contact the extension portions 132, thereby positioning the extension portions 132 with respect to the terminal holding portion 141 (more briefly, the terminal housing 14). Furthermore, the terminal accommodating portion 142 surrounds the outer peripheral sides of the terminals 13 (the front sides of the extension portions 132 and the connection portions 131) having been positioned by the positioning protrusions 141*a* and the engaging protrusions 141*b*.

Hence, the terminal housing 14 can accommodate the two terminals 13 using the terminal accommodating portion 142 while the two terminals 13 are disposed coaxially and separated from each other by the terminal holding portion 141. When the terminals 13 are accommodated in the terminal housing 14, in a state in which the connection portion 131 of each terminal 13 is connected to the end portion 110 of the core wire 11 and the extension portion 132 of the terminal 13 is inserted into the housing opening 14*a*, the terminal housing 14 and the terminal 13 are moved relatively to each other. In this case, a sealing member (hereafter, a seal rubber) 15 for preventing water intrusion from the base end side to the terminal connection section is mounted on the electric wires 10. The seal rubber 15, made of an elastic material, such as rubber or resin, is integrally molded with a holder member (hereafter, a seal rubber holder) 151 and has through holes 15*a* into which the insulation coatings 12 of the two electric wires 10 are inserted respectively. Before the terminals 13 (the flat plate portions 131*a*) are connected to the end portions 110 of the core wires 11, the seal rubber 15 is set in a state in which the through holes 15*a* have been passed over the insulation coatings 12 of the two electric wires 10 from the terminal side in advance. Then, after the terminals 13 are connected to the core wires 11, when the section where the electric wires 10 are connected to the terminals is accommodated in the terminal housing 14, the terminal accommodating portion 142 is press-fitted on the outer periphery of the seal rubber 15 until the end of the terminal accommodating portion 142 on the base end side (the right end in FIG. 4) contacts the seal rubber holder 151, whereby the seal rubber 15 is fixed to the base end side of the terminal connection section. As a result, the seal rubber 15 is disposed between the insulation coatings 12 and the terminal accommodating portion 142 and between the two electric wires 10, thereby sealing therebetween.

Furthermore, a mounting groove 14*b*, in which a sealing member (hereafter, a housing packing) 16 for preventing water intrusion from the terminal side to the section where the electric wires 10 are connected to the terminals is mounted, is formed in the terminal housing 14. The housing packing 16 mounted in the mounting groove 14*b* is provided between the front portion (the fitting inlet for the terminals 13 formed in the holding member 98 shown in FIG. 3) of the counterpart connection device and the terminal accommodating portion 142, thereby sealing therebetween. In this case, the housing packing 16 has a rotation prevention piece 16*a* and is prevented from rotating with respect to the terminal housing 14 by fitting the rotation prevention piece 16*a* into the fit-in portion 14*c* formed in the mounting groove 14*b* so that they interfere with each other.

In the terminal housing 14 in which the terminals 13 are accommodated, the outer periphery of the terminal accommodating portion 142 is surrounded by a shield shell 17. The shield shell 17 has a bottom part (hereafter, a shield shell bottom part) 171 having through holes 17*a* that are passed over the insulation coatings 12 of the two electric wires 10 respectively, a cylindrical wall portion (hereafter, a shield shell wall portion) 172 extending from the shield shell bottom part 171 to the terminal side, and a shield shell fixing portion 173 extending in a flat shape from the shield shell wall portion 172 to the outside. Before the terminals 13 are accommodated in the terminal housing 14, the shield shell 17 is in a state in which the through holes 17*a* of the shield shell bottom part 171 are passed over the insulation coatings 12 of the two electric wires from the terminal side in advance. During the accommodation work of the terminals 13 into the terminal housing 14, the shield shell 11 is retracted to the base end side instead of on the side of the end portions 110 of the core wires 11. Then, after the terminals 13 are connected to the core wires 11 and accommodated in the terminal housing 14, the shield shell 17 is moved to the terminal side along the insulation coatings 12 of the electric wires 10 having passed through the through holes 17*a*, and the distal end of the shield shell wall portion 172 is caused to abut against and is engaged with the flange section 142*a* provided to outwardly extend from the terminal accommodating portion 142. As a result, the shield shell 17 is positioned with respect to the electric wires 10.

The shield shell 17 configured as described above is connected to a portion (end portion) 103 from which the protection sheath 102 is stripped off and the shield conductor 101 is exposed. In this case, the end portion 103 of the shield conductor 101 is disposed on the outer periphery of the shield shell wall portion 172, and the end portion 103 is connected to the outer periphery of the shield shell wall portion 172 by compression-bonding using a ring member (shield ring) 18 that is disposed so as to cover the outer periphery. Furthermore, the shield shell 17 is fixed to the holding member 98 of the counterpart connection device using fixing members (bolts or the like) 99 inserted into fixing holes 173*a* bored in the shield shell fixing portion 173, and the electric wires 10 are shielded by grounding the shield conductor 101 via the counterpart connection device.

Figure 5:
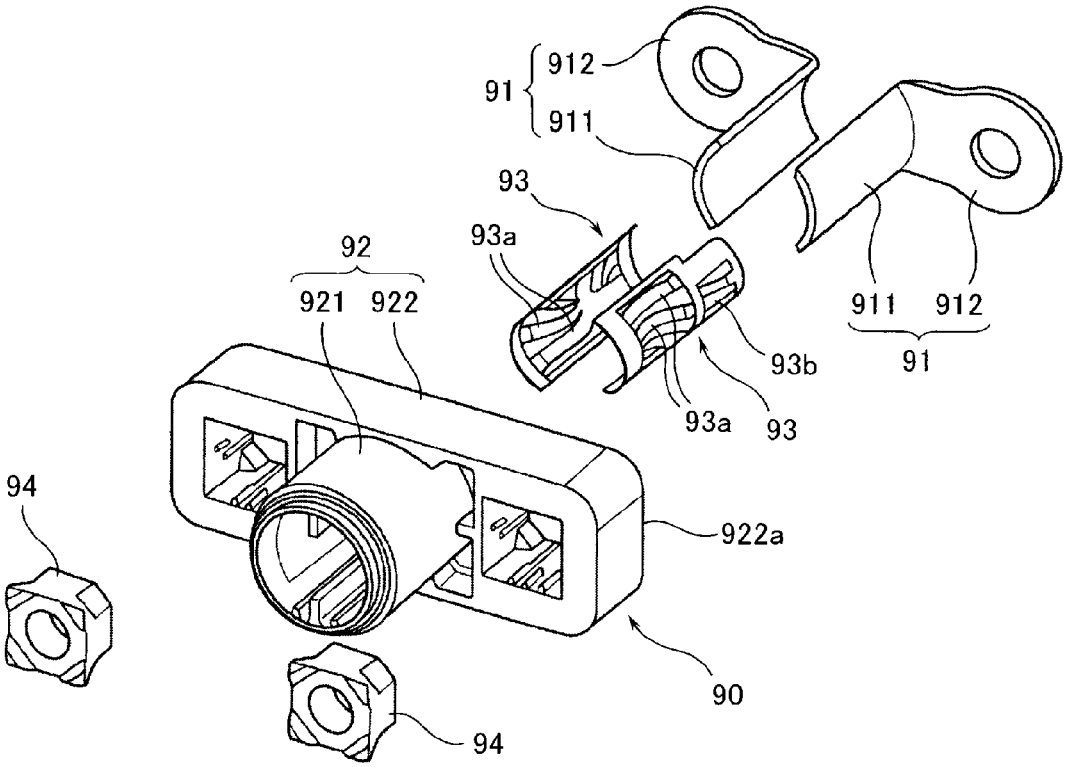
FIG. 5 is a perspective view illustrating terminal members (terminal base) of the counterpart connection device according to the first embodiment of the present invention with the components thereof disassembled.
Figure 6A:
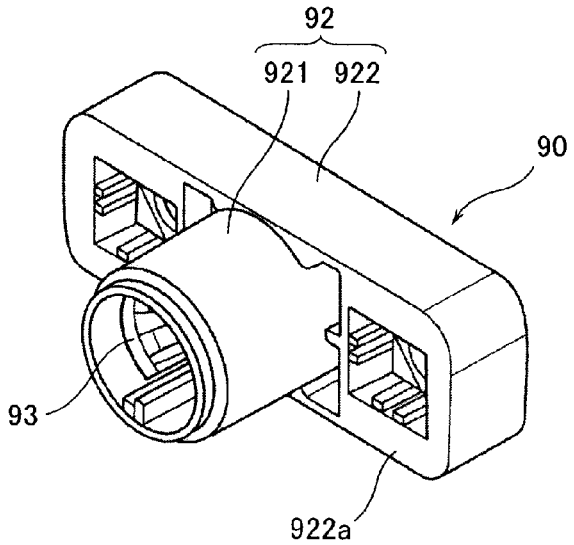
Figure 6B:
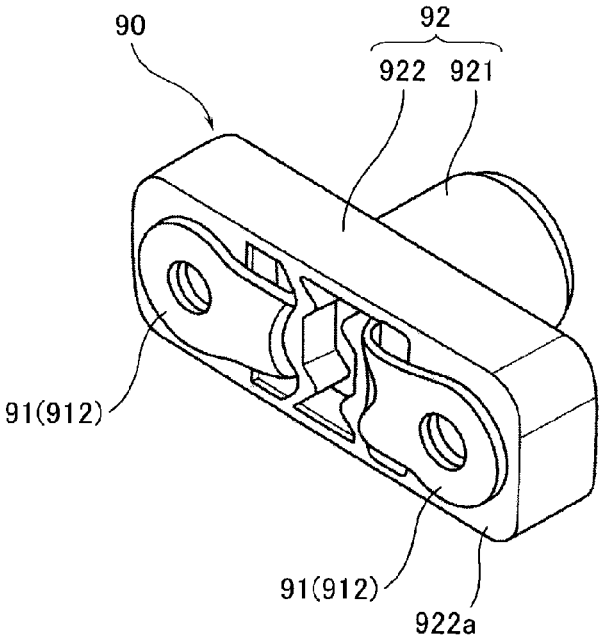
Figure 8A:
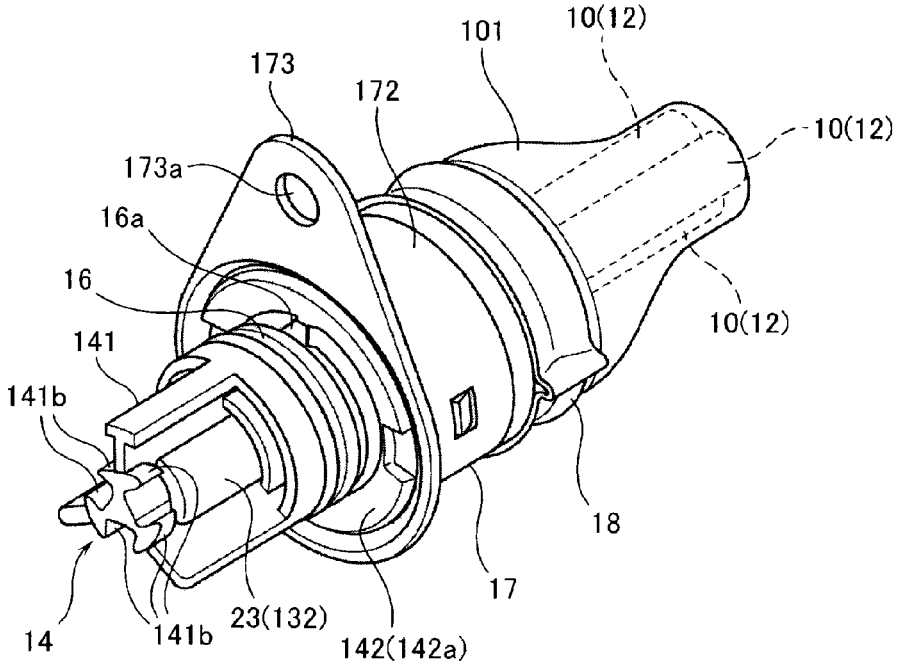
Figure 8B:
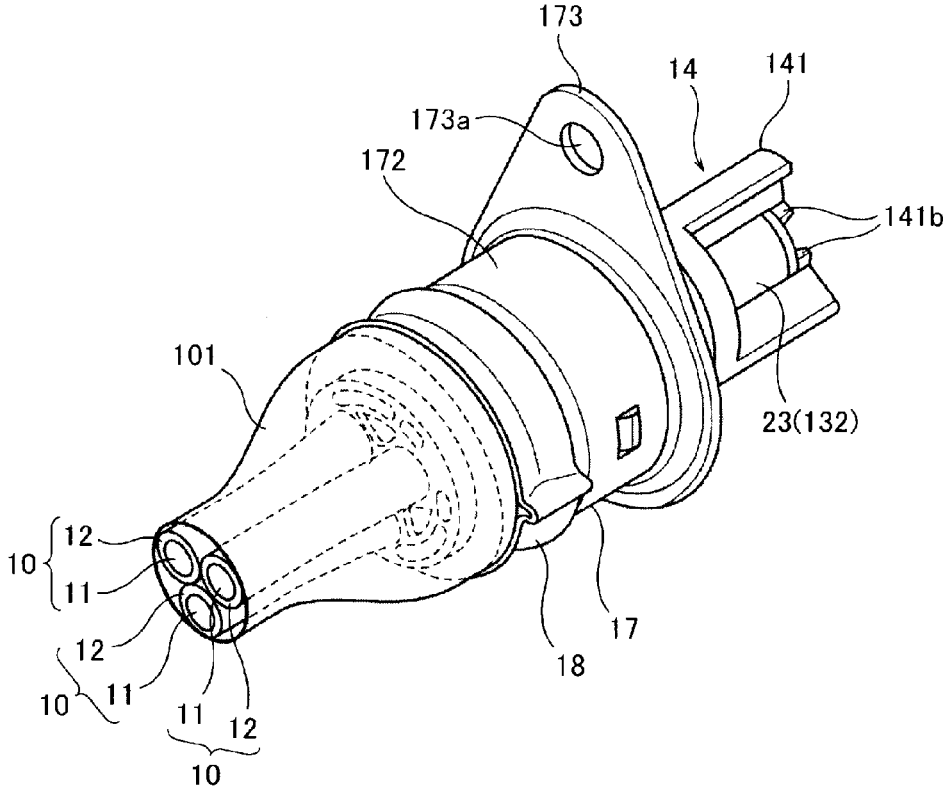

The terminals 13 are connected to terminal members (hereafter, a terminal base) in the counterpart connection device, whereby the electric wires 10 are electrically connected to the counterpart connection device via the terminal base. FIG. 5 is a perspective view illustrating the terminal base according to this embodiment with the components thereof disassembled. FIGS. 6A and 8B are perspective views of the entire terminal base, FIG. 6A is a perspective view illustrating a state in which the components shown in FIG. 5 are assembled, viewed from the terminal side, and FIG. 6B is a perspective view illustrating a state in which the components shown in FIG. 5 are assembled, viewed from the side opposite to that shown in FIG. 6A.

As shown in FIGS. 4 to 6B, the terminal base 90 includes terminal members (hereafter, terminal base terminals) 91 to be connected to the terminals 13 of a plurality (two in this embodiment) of electric wires 10, and a housing member (hereafter, a terminal base housing) 92 holding the terminal base terminals 91.

The terminal base terminal 91 has a end portion 911 extending in an arc shape and a contact portion 912 provided so as to protrude from one end of the end portion 911 in a diameter expanding direction in a flat plate shape. Furthermore, in the two terminal base terminals 91, the end portions 911 of the terminal base terminals 91 are disposed coaxially so as to be opposed to each other and formed into a substantially cylindrical shape. In this embodiment, the end portions 911 are extended in a substantially semi-cylindrical shape so as to have the same curvature. Hence, in the case that the end portions 911 of the two terminal base terminals 91 are disposed coaxially, the end portions 911 can be used as one set so as to be opposed to each other and formed into a substantially cylindrical shape. In this case, the end portions 911 of the two terminal base terminals 91 are respectively formed into a substantially semi-cylindrical shape having a curvature such that the inside diameter of the cylindrical shape formed by disposing the end portions coaxially so as to be opposed to each other and formed into a cylindrical shape is larger than the outside diameter of the extension portions 132 of the two terminals 13 similarly disposed coaxially so as to be opposed to each other and formed into a substantially cylindrical shape. With this configuration of the terminal base terminals 91, the size of the terminal base 90 is not required to be enlarged in the arrangement direction of the terminal base terminals, for example, unlike the case in which two terminal base terminals are arranged in parallel. In addition, the terminal base terminals 91 are not required to be formed into, for example, a cylindrical shape, whereby the configuration thereof can be simplified and the processing cost thereof can be reduced. In the state in which the contact portions 912 are held on the terminal base housing 92 together with the end portions 911, the contact portions 912 are exposed to the outside from the terminal base housing 92, whereby the contact portions 912 are configured so as to serve as an interface when the end portions 911 (more briefly, the terminal base terminals 91)

connected to the terminals 13 are connected to the electric wires, bus bar or the like of the counterpart connection device.

In this embodiment, the terminal base 90 has a plurality (two as an example) spring parts 93 that contacts the extension portions 132 of the terminals 13 and the terminal base terminals 91 so as to electrically connect the extension portions 132 and the terminal base terminals 91 to each other. In this embodiment, the spring part 93 is configured as a component (separate member) separated from the extension portion 132 and the terminal base terminal 91, however, the spring part may be configured so as to be integrated (as the same member) with the extension portion 132 or the terminal base terminal 91.

The two spring parts 93 are each extended to have a cross section of an arc shape and are arranged such that their cross sections are arranged in a substantially cylindrical manner and such that the spring parts 93 are spaced from each other in the circumferential direction. In this embodiment, each of the two spring parts 93 is formed into a substantially semi-cylindrical shape along the curves of the extension portion 132 and the end portion 911 of the terminal base terminal 91 having substantially semi-cylindrical shapes. The spring part 93 generates a predetermined elastic force (pushing force) when bent and deformed elastically, thereby maintaining the contact state between the extension portion 132 and the end portion 911 by using the pushing force so that electrical connection can be established therebetween. The configuration of the spring part 93 is not limited particularly, provided that such an electrical connection state as described above can be established. In this embodiment, a configuration is taken as an example in which a plurality of slits are formed in the cylindrical axial direction of the spring part 93 so as to provide spring elements 93*a* between the slits, and the spring elements 93*a* are formed into a curved concave shape in a diameter shrinking direction so that the spring elements can be bent and deformed elastically. The two spring parts 93 are disposed so as to be opposed to each other and formed into a substantially cylindrical shape and so as to be coaxial with the extension portions 132 and the end portions 911. Moreover, opening (hereafter, spring openings) 93*b* for engaging with an engaging portion (hereafter, a housing engaging portion) 92*a* provided on the terminal base housing 92 to be described later are formed in the spring parts 93.

The terminal base housing 92 has a terminal holding portion 921 configured to hold the end portions 911 and a contact holding portion 922 configured to hold the contact portions 912. In the terminal base housing 92, the end portions 911 of the terminal base terminals 91 are inserted into the terminal holding portion 921 of the terminal base housing 92 from the base end side (the left side in FIG. 4). Then, the spring parts 93 are inserted from the base end side to the inner peripheral sides of the end portions 911. Consequently, the housing engaging portion 92*a* is engaged with the edge of the spring openings 93*b*, whereby the spring parts 93 can be positioned and fixed with respect to the terminal base housing 92. Furthermore, the end portions 911 are held between the spring parts 93 and the terminal holding portion 921, whereby the terminal base terminals 91 can be positioned and fixed with respect to the terminal base housing 92. The contact holding portion 922 is configured to protrude from the outer periphery of the terminal holding portion 921 and has a contact face 922*a* that holds the contact portions 912 contacting the contact face 922*a*. That is, in the contact holding portion 922, in a state in which the terminal base terminals 91 are positioned and fixed to the terminal base housing 92, the contact portions 912 are held in contact with the contact face 922*a*. As a result, the terminal base housing 92 is set to a state in which the two terminal base terminals 91 (the end portions 911) are disposed coaxially while being separated from each other and held by the terminal holding portion 921.

Then, the terminal holding portion 141 of the terminal housing 14 is fitted in the terminal holding portion 921 of the terminal base housing 92. Hence, the extension portions 132 of the terminals 13 are fitted on the inner peripheral sides of the spring parts 93 against the elastic force (pushing force) of the spring parts 93, whereby the extension portions 132 can be caused to contact the end portions 911 by the elastic force. That is, the end portions 911 are connected to the extension portions 132 via the spring parts 93, whereby the terminal base terminals 91 and the terminals 13 can be electrically connected. In this state, the terminal holding portion 921 is positioned in a state in which the distal end (the right end in FIG. 4) of the terminal holding portion 921 contacts the distal end (the left end in FIG. 4) of the terminal accommodating portion 142. In this case, the distal end portion of the terminal holding portion 921 and the distal end portion of the terminal accommodating portion 142 are formed so as to protrude alternately to each other and to mesh with each other.

Consequently, the terminal base 90 in which the terminal base terminals 91 and the spring parts 93 are assembled and integrated with the terminal base housing 92 can be connected to the electric wires 10. Furthermore, the contact portions 912 of the terminal base terminals 91 connected to the terminals 13 are connected to the electric wires, bus bar or the like of the counterpart connection device using nuts 94, whereby the electric wires 10 are set to a state of being able to be electrically connected to the counterpart connection device at the terminal base 90. The electric wires 10 connected to the terminal base 90 are fixed to the holding member 98 of the counterpart connection device using the fixing members 99, such as screws (see FIGS. 3 and 4).

With the connection structure according to this embodiment, the plurality (two, for example) of terminals 13 can be disposed while being separated so that the axial centers of the extension portions 132 are coaxial, whereby the size of the section where the electric wires 10 are connected to the terminals can be reduced. In addition, the extension portions 132 of the terminals 13 are formed into an arc shape (e.g., a substantially semi-cylindrical shape), and the plurality of terminals 13 are disposed so as to be opposed so that these are formed into a substantially cylindrical shape. Hence, the configuration of the terminals 13 can be simplified, whereby the processing cost thereof can be reduced. Furthermore, since the plurality (two, for example) of spring parts 93 are disposed so as to be opposed as one set and formed into a substantially cylindrical shape, they are not disposed so as to be overlapped with one another in the radial direction. Consequently, the insertion load (insertion force) that is exerted when the terminals 13 are inserted into the terminal base 90 can be reduced, whereby the work for connecting the electric wires 10 to the terminals can be improved. In addition, in the terminal base 90 according to this embodiment, the plurality (two, for example) of terminal base terminals 91 can be disposed coaxially while being separated from one another. Hence, by using the terminal base 90 for the connection between the electric wires 10 and the counterpart connection device, the size of the terminal connection section of the counterpart connection device can also be reduced, and as a result, the size of the section where the electric wires 10 are connected to the terminals can be further reduced. Furthermore, as in the case of the terminals 13, the configuration of the terminal base terminals 91 can be simplified and the processing cost thereof can be reduced.

In the first embodiment described above, the two terminals 13 are connected to the two electric wires 10, each terminal being connected to a corresponding one of the electric wires. However, the number of the plurality of electric wires 10 to which the terminals 13 are connected may be three or more. For example, FIGS. 7 to 13B illustrate a connection structure in which three terminals are connected to three electric wires, each terminal being connected to a corresponding one of the electric wires. This connection structure will be described below as a second embodiment according to the present invention. Since the basic configuration of the second embodiment is similar to that of the first embodiment described above, the same components as those of the first embodiment or components similar thereto are designated by the same reference numerals in the drawings, and the differences from the first embodiment will be described below.

Second Embodiment

Figure 7:
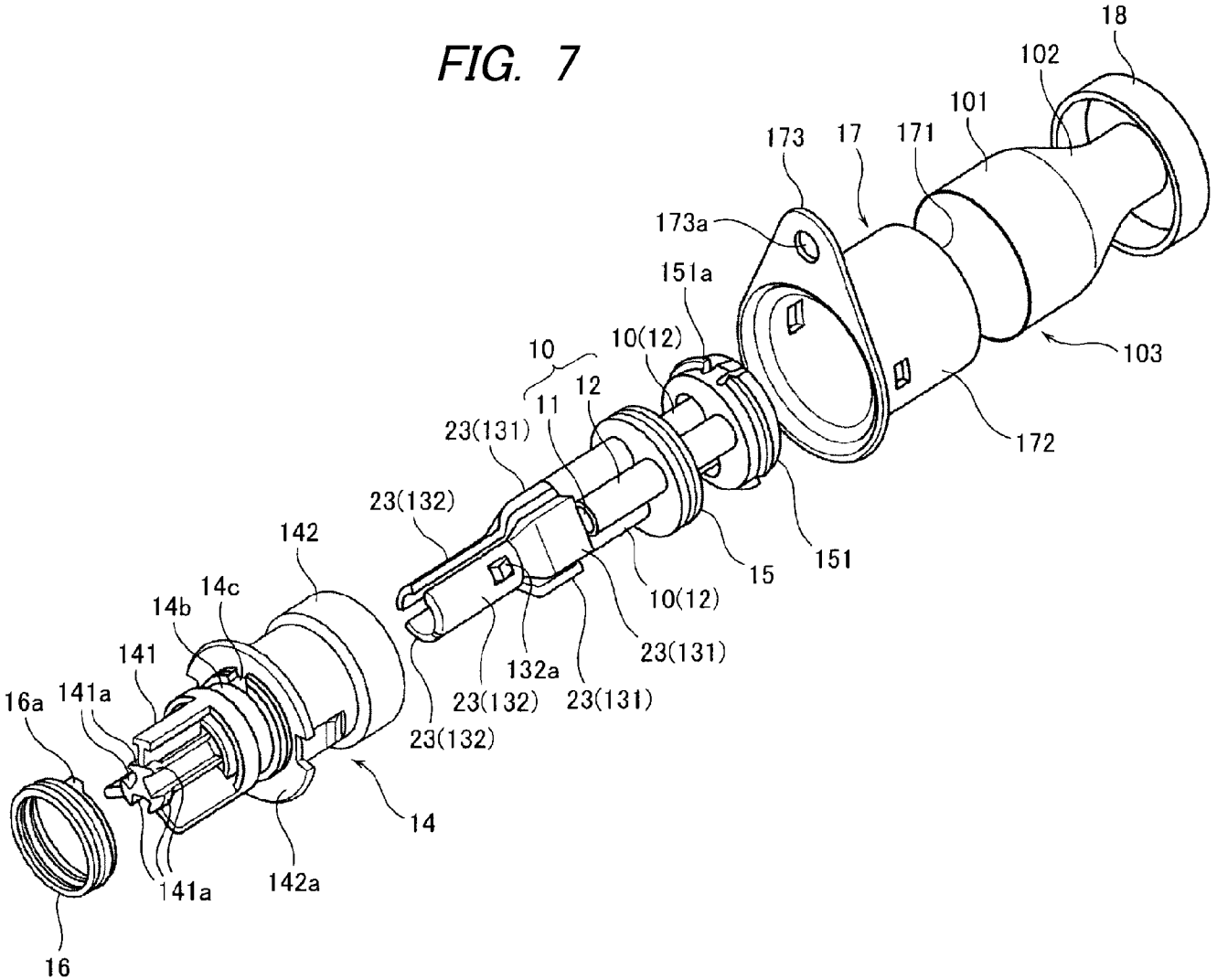
FIG. 7 is a perspective view illustrating a multiple wire terminal connection structure according to a second embodiment of the present invention with the components thereof disassembled.
Figure 9:
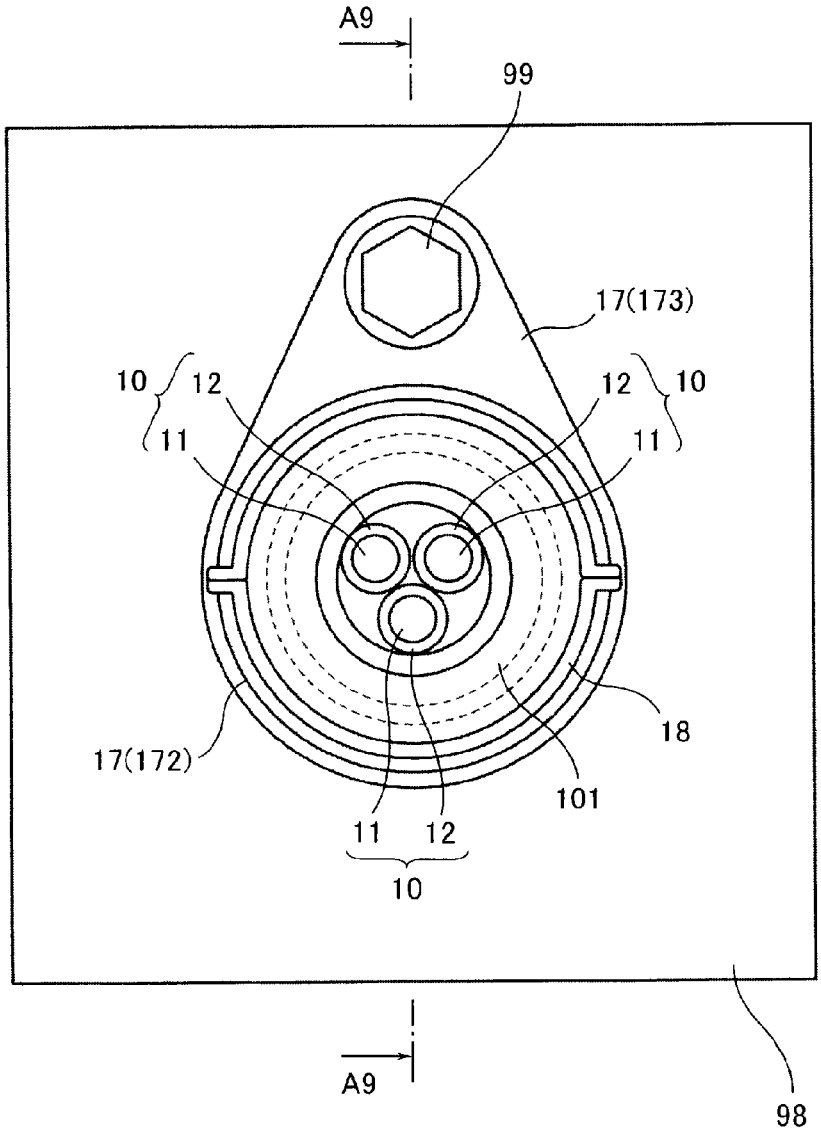
FIG. 9 is a view illustrating a state in which the multiple wire terminal connection structure according to the second embodiment of the present invention is fixed to a counterpart connection device, viewed from the electric wire side.
Figure 10:
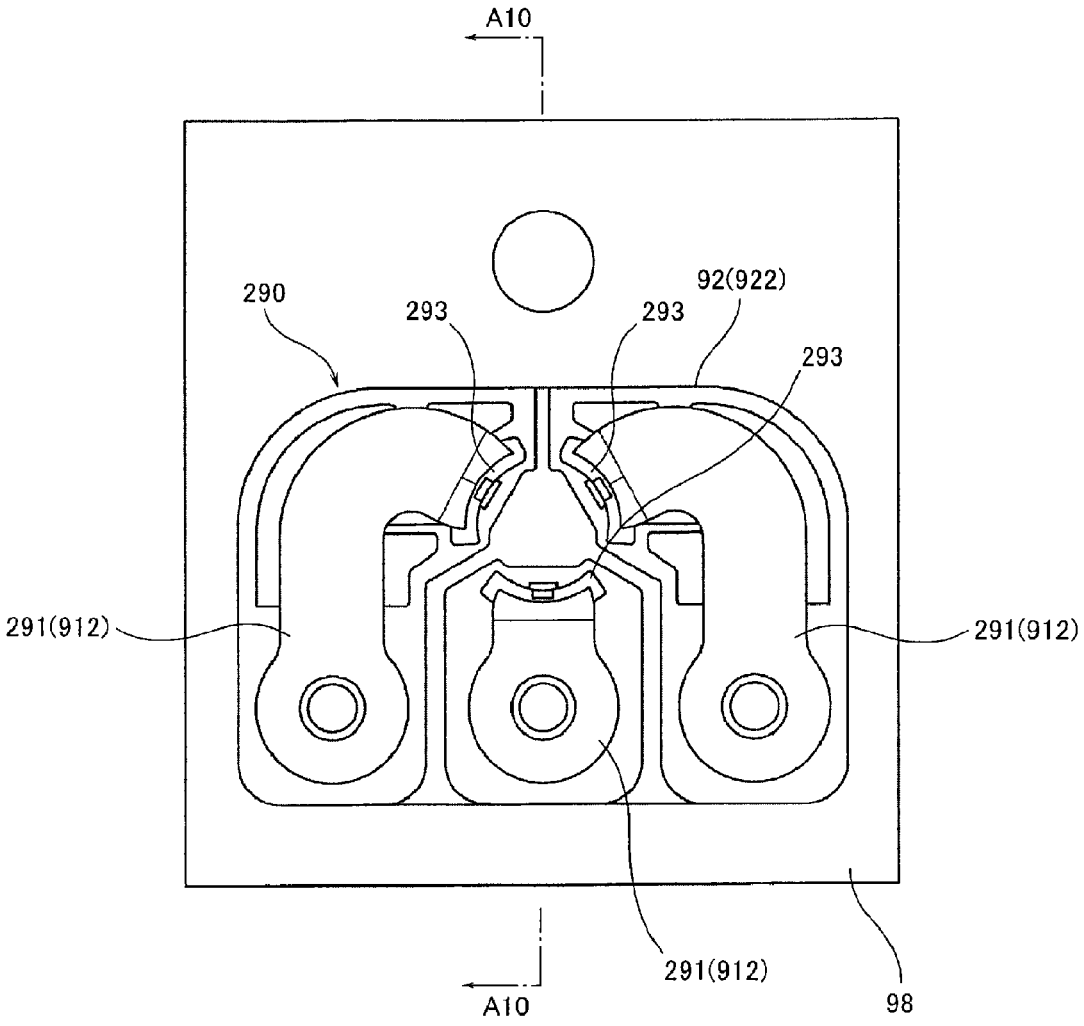
FIG. 10 is a view illustrating a state in which the multiple wire terminal connection structure according to the second embodiment of the present invention is fixed to the counterpart connection device, viewed from the terminal base side.
Figure 11:
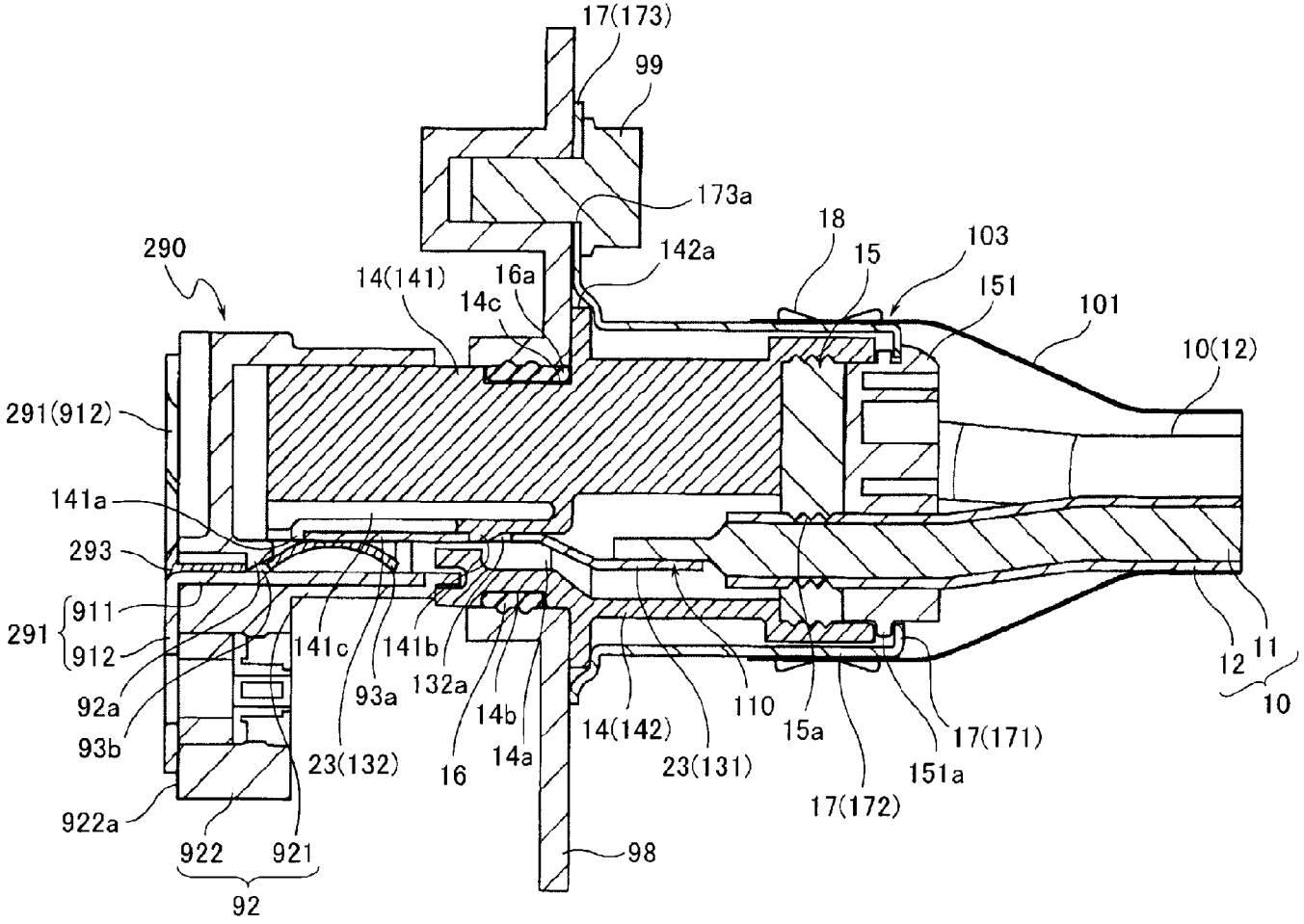
FIG. 11 is a longitudinal sectional view taken along the arrows A9 in FIG. 9 (the portion indicated by arrow A10 in FIG. 10), and viewed from the direction of the arrows.

FIGS. 7 to 13B illustrate a connection structure according to the second embodiment of the present invention. FIG. 7 is a perspective view illustrating the connection structure with the components thereof disassembled. FIGS. 8A and 8B are perspective views of the overall connection structure, FIG. 8A is a perspective view illustrating a state in which the components shown in FIG. 7 are assembled, viewed from the terminal side, and FIG. 8B is a perspective view illustrating a state in which the components are assembled, viewed from the side opposite to that shown in FIG. 8A. FIG. 9 is a view illustrating a state in which the connection structure is fixed to a counterpart connection device, viewed from the electric wire side, and FIG. 10 is a view illustrating a state in which the connection structure is fixed to the counterpart connection device, viewed from the terminal base side. FIG. 11 is a longitudinal sectional view taken along the arrows A9 in FIG. 9 (taken along the arrows A10 in FIG. 10), and viewed from the direction of the arrows.

As shown in FIGS. 7 to 13B, in this embodiment, three terminals 23 are connected to three electric wires 10, the core wires of which being each coated with an insulation coating 12, and each terminal being connected to a corresponding one of the electric wires. The extension portions 132 of the terminals 23 are extended from the connection portions 131 thereof in an arc shape so as to have the same curvature. With this configuration, in the case that the extension portions 132 of the three terminals 23 are disposed coaxially at equal intervals (at a phase difference of 120°), they can be opposed to one another as one set so as to be formed into a substantially cylindrical shape.

The three terminals 23 disposed as described above are accommodated in the terminal housing 14 while being disposed coaxially and separated from one another. The seal rubber 15 is mounted on the electric wires 10 accommodated in the terminal housing 14 as in the case of the first embodiment to prevent water intrusion from the base end side to the terminal connection section. However, in this embodiment, the seal rubber 15 is separated from the seal rubber holder 151 serving as a holder member. In this embodiment, the seal rubber holder 151 is mounted on the base end side (the right side in FIG. 11) of the electric wires 10 instead of on the side of the seal rubber 15, and the seal rubber 15 is made close contact with the terminal side (the left side in FIG. 11) of the seal rubber holder 151, whereby the seal rubber 15 is positioned and held. With this configuration, the seal rubber 15 maintains sealing performance between the insulation coatings 12 and the terminal accommodating portion 142 and among the three electric wires 10. The housing packing 16 mounted in the mounting groove 14*b* of the terminal housing 14 seals between the front portion (the fitting inlet for the terminals 13 formed in the holding member 98 shown in FIGS. 9 and 10) of the counterpart connection device and the terminal accommodating portion 142, thereby preventing water intrusion from the terminal side to the section where the electric wires 10 are connected to the terminals, as in the case of the first embodiment.

In the terminal housing 14 accommodating the terminals 23, the outer periphery of the terminal accommodating portion 142 is surrounded by the shield shell 17, and the end portion 103 of the shield conductor 101 is connected to the shield shell 17 by compression-bonding using the shield ring 18. The shield shell 17 is then fixed to the holding member 98 of the counterpart connection device, and the shield conductor 101 is grounded via the counterpart connection device, whereby the electric wires 10 are shielded. The bottom part 171 of the shield shell 17 is engaged with the engaging portion (seal rubber holder engaging portion) 151*a* formed on the outer periphery of the seal rubber holder 151, whereby the shield shell 17 is positioned with respect to the electric wires 10.

Figure 12:
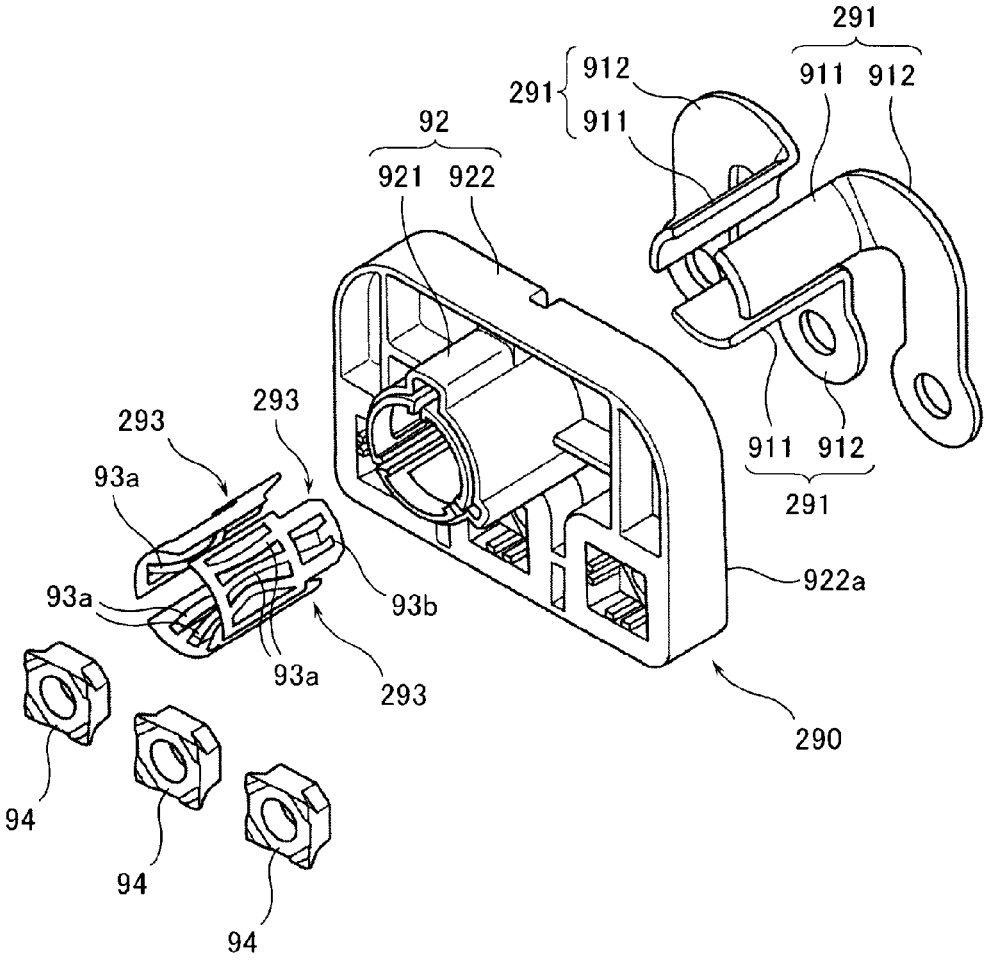
FIG. 12 is a perspective view illustrating terminal members (terminal base) in the counterpart connection device according to the second embodiment of the present invention with the components thereof disassembled.
Figure 13A:
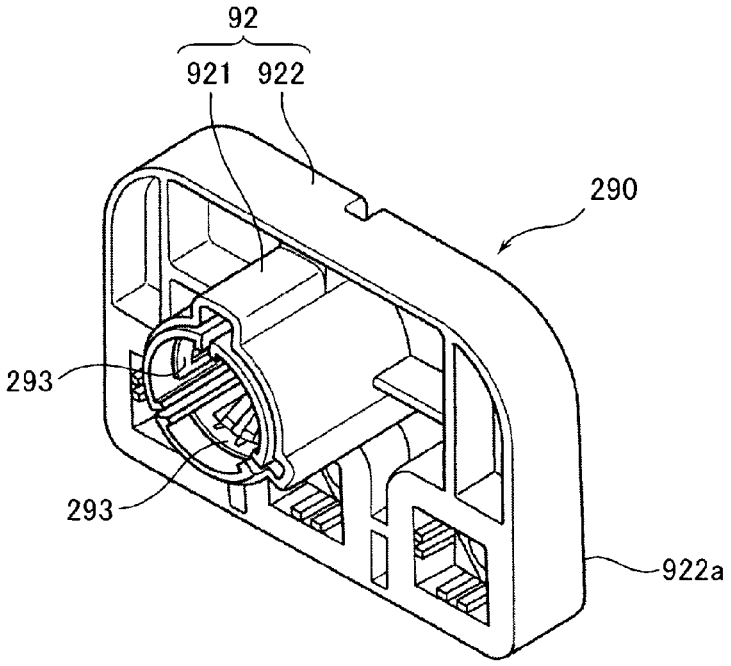
Figure 13B:
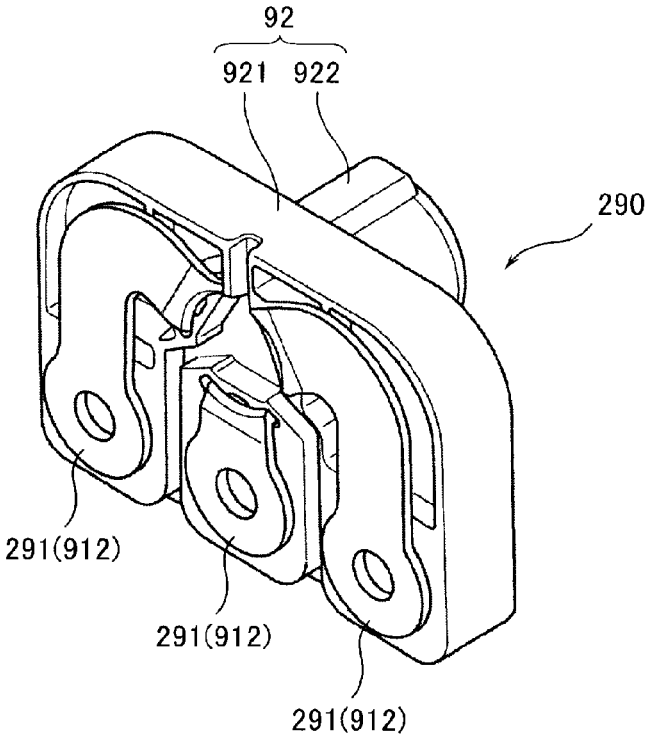

The terminals 23 are connected to a terminal base 290, and the electric wires 10 are electrically connected to the counterpart connection device via the terminal base 290. In this embodiment, since the basic configuration of the terminal base 290 is similar to that of the terminal base 90 (see FIGS. 5, 6A and 6B) according to the first embodiment described above, the same components as those of the first embodiment or components similar thereto are designated by the same reference numerals in the drawings and the descriptions thereof are omitted. FIG. 12 is a perspective view illustrating the terminal base 290 according to this embodiment with the components thereof disassembled. FIGS. 13A and 13B are perspective views of the entire terminal base 290, FIG. 13A is a perspective view illustrating a state in which the components shown in FIG. 12 are assembled, viewed from the terminal side, and FIG. 13B is a perspective view illustrating a state in which the components shown in FIG. 12 are assembled, viewed from the side opposite to that shown in FIG. 13A.

The terminal base 290 includes three terminal base terminals 291 respectively connected to the three terminals 23. The end portions 911 of the respective terminal base terminals 291 extend in an arc shape so as to have the same curvature. With this configuration, in the case that the end portions 911 of the three terminal base terminals 291 are disposed coaxially at equal intervals (at a phase difference of 120°), they can be opposed to one another as one set and formed into a substantially cylindrical shape. In this case, the end portions 911 of the three terminal base terminals 291 are respectively formed into an arc shape having a curvature such that the inside diameter of the cylindrical shape formed by disposing the end portions coaxially so as to be opposed to one another and formed into a cylindrical shape is larger than the outside diameter of the extension portions 132 of the three terminals 23 similarly disposed coaxially so as to be opposed to one another and formed into a substantially cylindrical shape.

The terminal base 290 has three spring parts 293 extending in an arc shape to contact the extension portions 132 of the terminals 23 and the terminal base terminals 291 so as to electrically connect the extension portions 132 and the terminal base terminals 291 to each other. Each of the spring parts 293 is formed into an arc shape along the curves of the extension portion 132 and the end portion 911 of the terminal base terminal 291 having arc shapes.

In the terminal base housing 92, the end portions 911 of the terminal base terminals 291 are inserted into the terminal holding portion 921 of the terminal base housing 92 from the base end side (the left side in FIG. 11), and the spring parts 293 are inserted from the base end side to the inner peripheral sides of the end portions 911. Consequently, the three spring parts 293 are positioned and fixed with respect to the terminal base housing 92, and the end portions 911 are held between the spring parts 293 and the terminal holding portion 921, whereby the three terminal base terminals 291 are positioned and fixed with respect to the terminal base housing 92. Furthermore, the terminal base housing 92 is set to a state in which the three terminal base terminals 291 (the end portions 911) are disposed coaxially while being separated from one another and held by the terminal holding portion 921.

When the terminal holding portion 141 of the terminal housing 14 is fitted in the terminal holding portion 921 of the terminal base housing 92, the extension portions 132 can be caused to contact the end portions 911 by the elastic force (pushing force) of the spring parts 293. That is, the end portions 911 are connected to the extension portions 132 via the spring parts 293, whereby the terminal base terminals 291 and the terminals 23 can be electrically connected.

Consequently, the terminal base 90 in which the terminal base terminals 91 and the spring parts 293 are assembled and integrated with the terminal base housing 92 can be connected to the electric wires 10. Furthermore, the contact portions 912 of the terminal base terminals 291 connected to the terminals 23 are connected to the electric wires, bus bar or the like of the counterpart connection device using the nuts 94, whereby the electric wires 10 are set to a state of being able to be electrically connected to the counterpart connection device at the terminal base 290.

In the first embodiment and the second embodiment described above, the plurality of terminals 13 (the extension portions 132) are coaxially arranged along the direction in which the electric wires 10 extend. However, also with the terminals configured such that the axial centers of the arc shapes of the extension portions 132 extend in a direction intersecting the direction in which the electric wires 10 extend, a similar advantage can be obtained. Such a configuration modified as described above will be described below as a third embodiment of the present invention. Since the basic configuration of the third embodiment is similar to that of the first embodiment described above, the same components as those of the first embodiment or components similar thereto are designated by the same reference numerals in the drawings, and the differences from the first embodiment will be described below.

Third Embodiment

Figure 14:
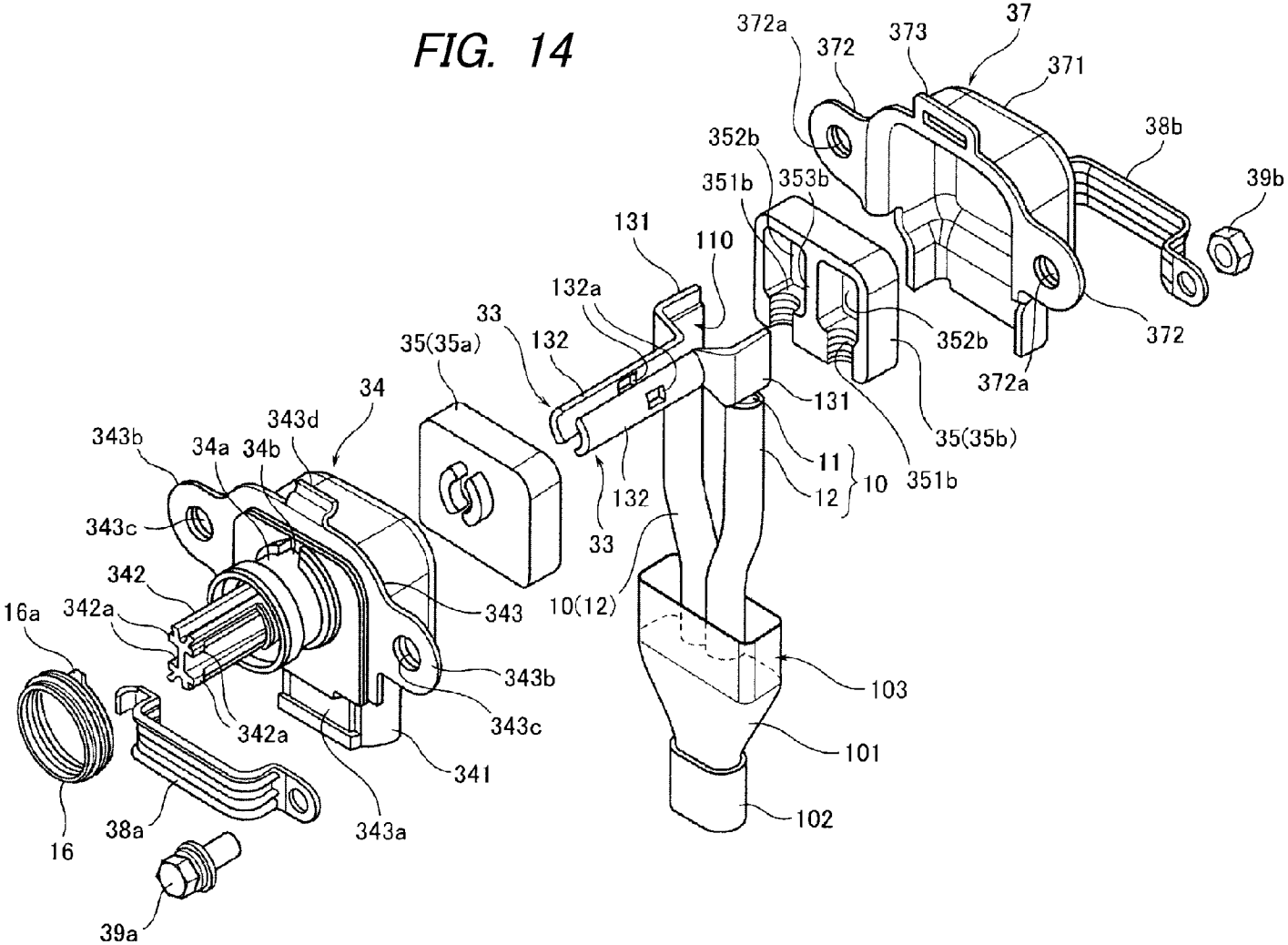
FIG. 14 is a perspective view illustrating a multiple wire terminal connection structure according to a third embodiment of the present invention with the components thereof disassembled.
Figure 15A:
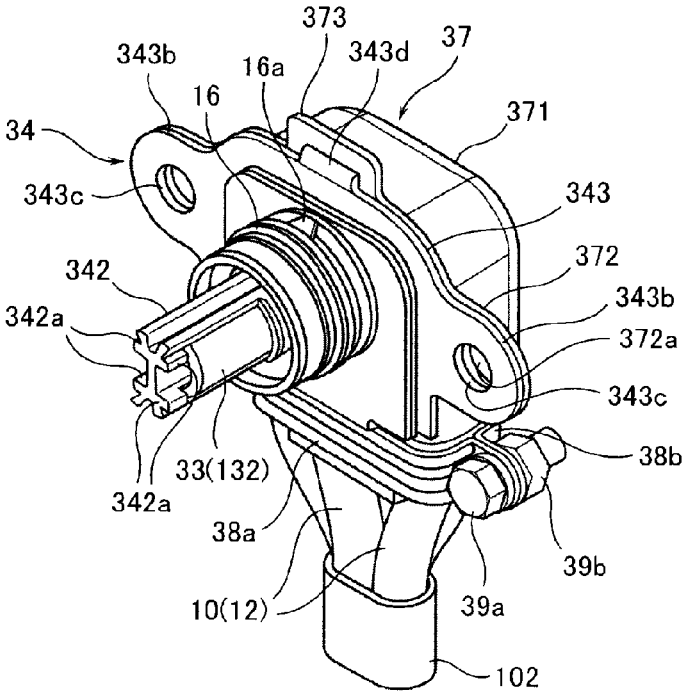
Figure 15B:
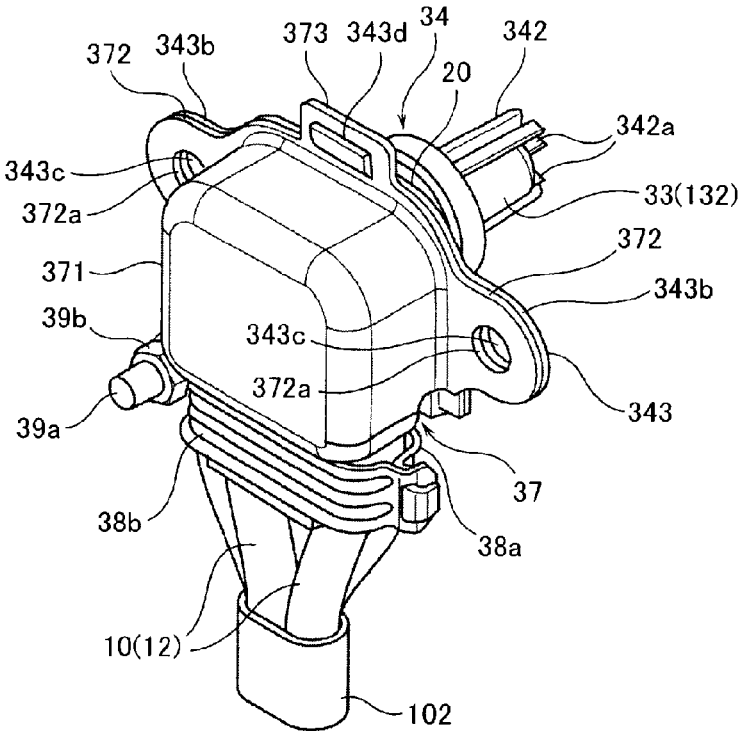
Figure 16:
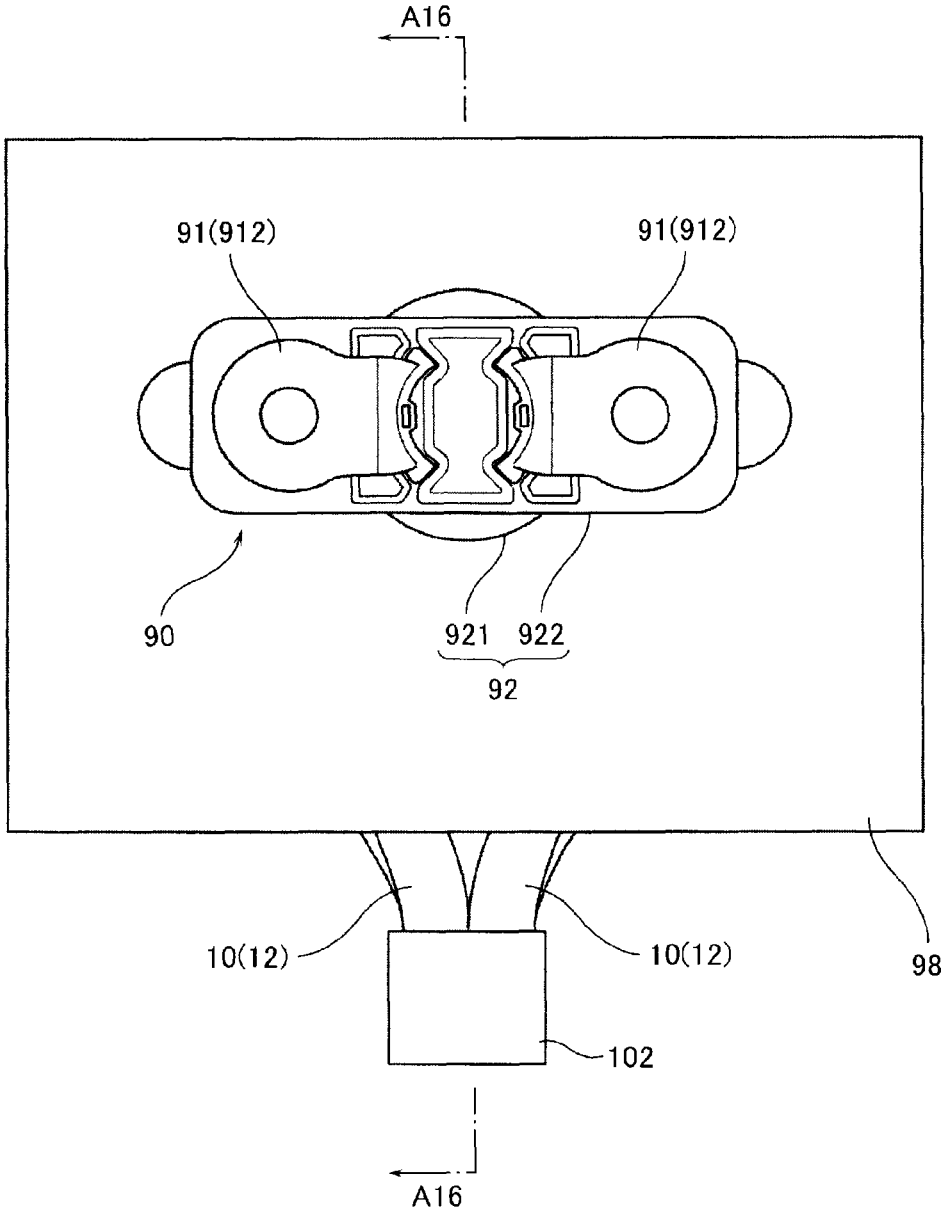
FIG. 16 is a view illustrating a state in which the multiple wire terminal connection structure according to the third embodiment of the present invention is fixed to a counterpart connection device, viewed from the terminal base side.
Figure 17:
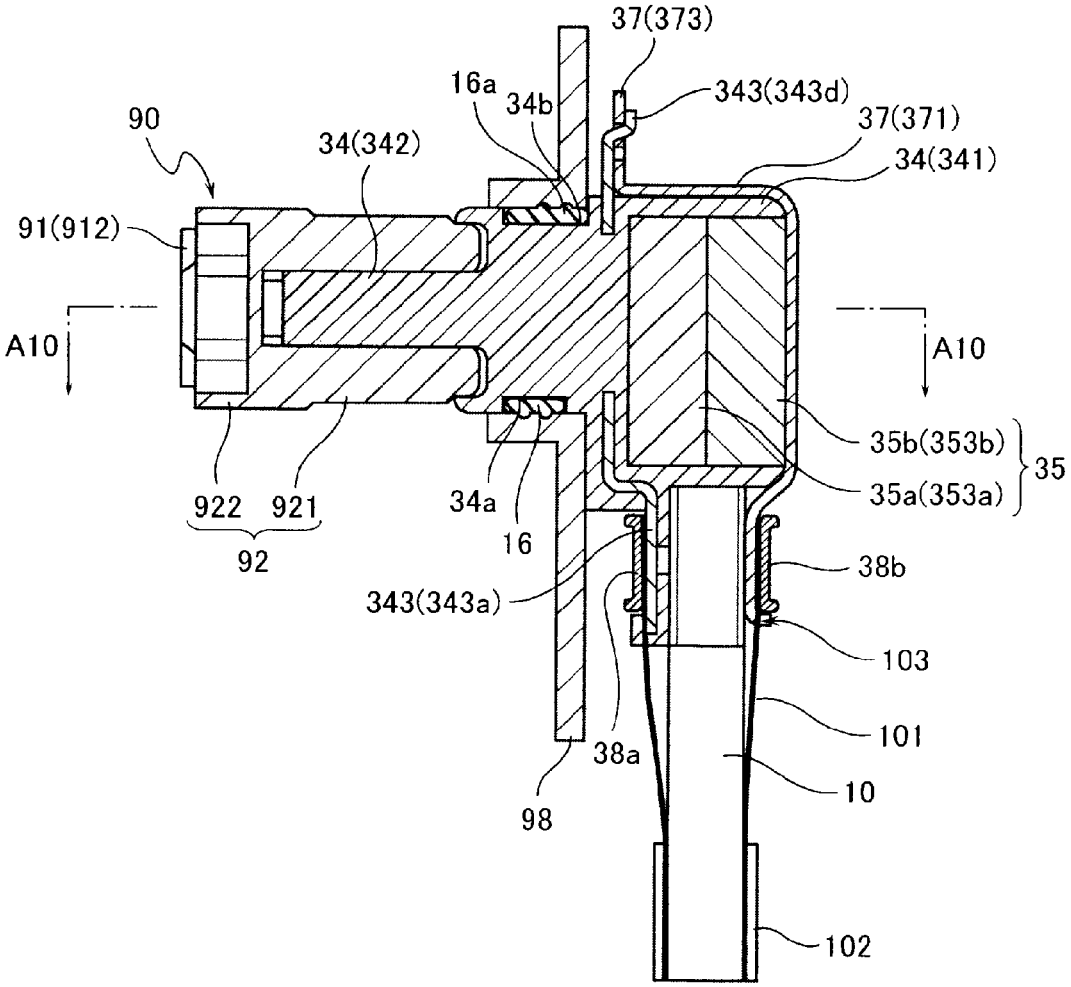
FIG. 17 is a longitudinal sectional view taken along the arrows A16 in FIG. 16, and viewed from the direction of the arrows.
Figure 18:
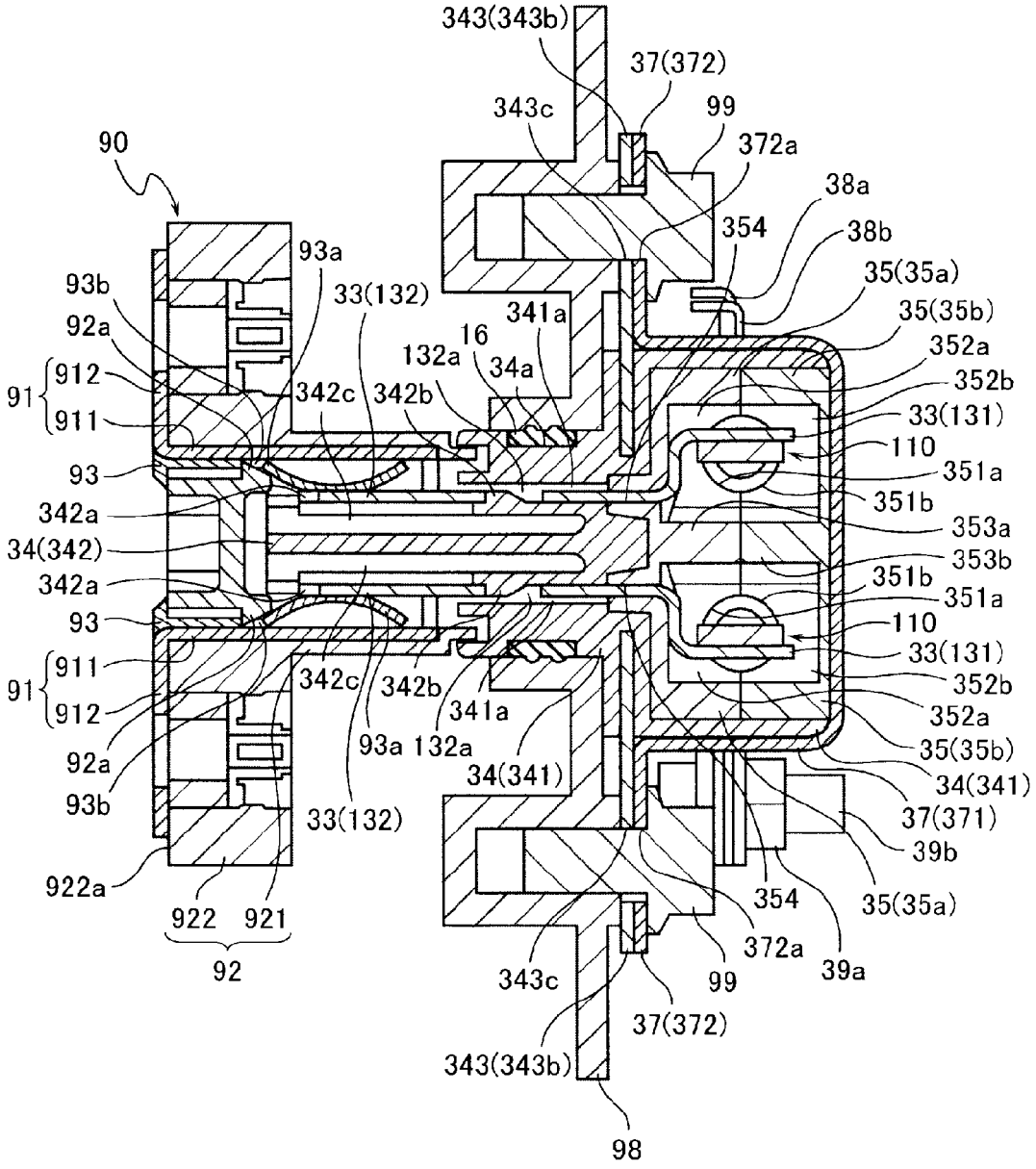
FIG. 18 is a longitudinal sectional view taken along the arrows A17 in FIG. 17, and viewed from the direction of the arrows.

FIGS. 14 to 18 illustrate a connection structure according to a third embodiment of the present invention. FIG. 14 is a perspective view illustrating the connection structure with the components thereof disassembled. FIGS. 15A and 15B are perspective views of the overall connection structure, FIG. 15A is a perspective view illustrating a state in which the components shown in FIG. 14 are assembled, viewed from the terminal side, and FIG. 15B is a perspective view illustrating a state in which the components are assembled, viewed from the side opposite to that shown in FIG. 15A. FIG. 16 is a view illustrating a state in which the connection structure is fixed to a counterpart connection device, viewed from the terminal base side. FIG. 17 is a longitudinal sectional view taken along the arrows A16 in FIG. 16, and viewed from the direction of the arrows, and FIG. 18 is a longitudinal sectional view taken along the arrows A17 in FIG. 17, and viewed from the direction of the arrows.

While the connection structure according to the first embodiment (see FIGS. 1 to 4) and the connection structure according to the second embodiment (see FIGS. 7 to 11) are straight types in which the electric wires 10 and the counterpart connection device are connected in the direction in which the electric wires 10 extend, the connection structure according to this embodiment is an L-type in which the electric wires 10 and the counterpart connection device are connected at substantially right angles as shown in FIGS. 14 to 18. Hence, in this embodiment, a plurality of terminals 33 are arranged such that the axial centers of the arc shapes of the extension portions 132 extend along a direction (the lateral direction in FIG. 17, hereafter referred to as a connection direction) substantially perpendicularly intersecting the direction in which the plurality of electric wires 10 extend (the vertical direction in FIG. 17).

As shown in FIGS. 14 to 18, in this embodiment, the two terminals 33 are connected to two electric wires 10, the core wires 11 of which being each coated with the insulation coating 12, and each terminal being connected to a corresponding one of the electric wires. Each terminal 33 has a flat plate-shaped connection portion 131 to be joined to the end portion 110 of the core wire 11 and an extension portion 132 extended from one end of the connection portion 131 in an arc shape (e.g., a substantially semi-cylindrical shape) so that the two extension portions 132 have the same curvature. The connection portion 131 is joined to the end portion 110 by ultrasonic welding or the like so that the extension portion 132 extends in the direction of the connection. That is, the terminal 33 in the state of being connected to the core wire 11 is bent from the extension direction of the electric wire 10 to the connection direction and is integrated with the electric wire 10. As a result, in the case that the extension portions 132 of the two terminals 33 are disposed coaxially in the connection direction, the extension portions 132 can be opposed to each other so as to form a substantially cylindrical shape.

The two terminals 33 disposed as described above are hermetically enclosed from the outside using a sealing member (hereafter, a packing) 35. The packing 35 is formed of a non-conductive member, such as resin, and has a divided structure in which the bottom part 35*a* and the lid part 35*b* thereof are assembled together from front and back of the connection direction to form a unitary body. The bottom part 35*a* and the lid part 35*b* have support portions 351*a*, 351*b* supporting the electric wires 10 while holding the wires 10 from both sides in the connection direction and accommodating portions 352*a*, 352*b* for respectively accommodating the terminal connection section of the two electric wires 10 supported by the support portions 351*a*, 351*b*. The accommodating portions 352*a*, 352*b* are partitioned for the respective electric wires 10 by partitioning portions 353*a*, 353*b*. The bottom part 35*a* and the lid part 35*b* are configured to contact each other at the peripheral portions thereof other than the base end side (the lower side in FIG. 17) in an assembled state, and the support portions 351*a*, 351*b* are configured to contact the insulation coatings 12 of the electric wires 10 at the base end side in the state in which the bottom part 35*a* and the lid part 35*b* are assembled. In addition, in this state, the partitioning portions 353*a*, 353*b* also contact with each other. Consequently, when the bottom part 35*a* and the lid part 35*b* are assembled together to form a unitary body, the terminal connection section of the electric wires 10 is covered and hermetically enclosed, and water intrusion (e.g., water intrusion along the insulation coatings 12 of the electric wires 10) into the terminals 33 can be prevented. Furthermore, the packing 35 is disposed between the two terminals 33 to insulate them, thereby also having a function of preventing short circuit. In addition, openings (hereafter, packing openings) 354 are formed in the bottom part 35*a* on both sides while the partitioning portion 353*a* is provided therebetween. The two extension portions 132 are respectively inserted into the packing openings 354, thereby being positioned so as to be opposed to each other and formed into a substantially cylindrical shape in a state in which the extension portions 132 are exposed to the outside from the bottom part 35*a* having been assembled with the lid part 35*b*. Moreover, the bottom part 35*a* by which the extension portions 132 are positioned as described above is assembled with the lid part 35*b* and integrated into the packing 15.

The integrated packing 35 is covered with a terminal housing 34 and a shield shell 37 having been assembled on both sides in the connection direction. In this case, the terminal housing 34 covers the bottom part 35*a* from one side in the connection direction and the shield shell 37 covers the lid part 35*b* from the other side in the connection direction, and the terminal housing 34 and the shield shell 37 are assembled by securing shield holders 38*a* and 38*b* with a bolt 39*a* and a nut 39*b*.

The terminal housing 34 has a housing body 341 configured to cover the surface of the bottom part 35*a*, a terminal holding portion 342 configured to hold the two terminals 33 while the two terminals 33 are separated from each other so that the axial centers of the substantially semi-cylindrical shapes of the extension portions 132 are coaxial, and an insert plate 343 formed on the housing body 341 by insert molding. An opening (hereafter, a housing opening) 341*a* into which the extension portions 132 having been exposed from the bottom part 35*a* are inserted is formed in the housing body 341, whereby the extension portions 132 having been inserted into the housing opening 341*a* are exposed to the outside from the housing body 341 having been used to cover the bottom part 35*a*. The terminal holding portion 342 holds the extension portions 132 having been exposed from the housing body 341 in the extension direction thereof. As a result, the terminals 33 are positioned so as to be connectable to the terminal members (the terminal base internal terminals and the terminal base external terminals of the terminal base) of the counterpart connection device.

The terminal holding portion 342 is provided with positioning protrusions 342*a* at the distal end portions of the extension portions 132 in the extension direction thereof and is also provided with engaging protrusions 342*b* on the front side of the positioning protrusions 342*a*. The positioning protrusions 342*a* and the engaging protrusions 342*b* are provided to protrude on a flexible arm extending in a cantilever shape along holding portion release grooves 342*c*. When the terminals 33 are accommodated in the terminal housing 34, the engaging protrusions 342*b* are moved to the opening sections (the terminal opening sections 132*a*) formed in the extension portions 132 along the inner peripheral faces of the extension portions 132 while contacting the inner peripheral faces of the extension portions 132 and being elastically bent and deformed so as to be toppled toward the holding portion release grooves 342*c*. When the engaging protrusions 342*b* are moved to the terminal opening sections 132*a*, the engaging protrusions 342*b* are elastically bent and deformed to return to the original shape thereof so as to be widened outward (in a diameter expanding direction) and then engaged with the terminal opening sections 132*a*. The positioning protrusions 342*a* serve as the positioning stoppers for the extension portions 132 having been inserted into the housing opening 341*a*. Hence, when the terminals 33 are accommodated in the terminal housing 34, the extension portions 132 can be positioned in a state of being properly exposed from the housing body 341 by sliding the extension portions 132 along the terminal holding portion 342 until they contact the positioning protrusions 342*a*. In this case, after elastically bent and deformed together with the engaging protrusions 342*b*, the positioning protrusions 342*a* being in a state of having been elastically bent and deformed and then returned to the original shape thereof simultaneously with the engaging protrusions 342*b* contact the extension portions 132, thereby positioning the extension portions 132 with respect to the terminal holding portion 342 (more briefly, the terminal housing 34).

The insert plate 343 is a member formed, for example, by pressing a metal plate and has a mounting portion 343*a* on which the shield holder 38*a* is mounted and fixing portions 343*b* configured to fix the electric wires 10 to the counterpart connection device. The mounting portion 343*a* is exposed along the bottom face of the mounting groove which is formed in the housing body 341 and in which the shield holder 38*a* is mounted, and the fastening force from the shield holder 38*a* mounted in the mounting groove is exerted to the mounting portion 343*a*. The fixing portions 343*b* being used as a pair are formed so as to protrude from the housing body 341 and provided with fixing holes 343*c* into which fixing members (bolts or the like) 99 are inserted.

The shield shell 37 has a shell body 371 configured to cover the lid part 35*b* and protrusions 372 protruding from the shell body 371. The shell body 371 is a housing that is formed so as to cover the surface of the lid part 35*b*. The protrusions 372, serving as fixing portions when the electric wires 1 are fixed to the counterpart connection device, are used as a pair and protrude from the periphery of the shell body 371 so as to be able to be overlapped with the fixing portions 343*b* of the terminal housing 34 (the insert plate 343), and are provided with fixing holes 372*a* into which fixing members (bolts or the like) are inserted so that the fixing holes 342*a* can communicate with the fixing holes 343*c*.

One of the insert plate 343 and the shield shell 37 is provided with an engaging portion and the other is provided with a counterpart engaging portion. Furthermore, when the engaging portion and the counterpart engaging portion are engaged with each other, the terminal housing 34 and the shield shell 37 are assembled. In this embodiment, a hook-shaped engaging portion (hereafter, a hook portion) 343*d* is provided on the insert plate 343, and a counterpart engaging portion (hereafter, an opening portion) 373 having an opening into which the hook portion 343*d* is inserted so as to be engaged therewith is provided in the shield shell 37.

In the state in which the hook portion 343*d* is engaged with the opening portion 373 and the terminal housing 34 and the shield shell 37 are assembled, the shield conductor 101 is connected to the mounting portion 343*a* of the insert plate 343 and the shell body 371. At the time of the connection, the end portion 103 of the shield conductor 101 is disposed so as to be mounted on the outer peripheries of the mounting portion 343*a* and the shell body 371, and the shield holders 38*a* and 38*b* are attached to the outer periphery of the end portion 103. The shield holders 38*a* and 38*b* are engaged with each other on one end sides thereof having a band shape and are secured to each other on the other end sides using the bolt 39*a* and the nut 39*b*, whereby the end portion 103 of the shield conductor 101 is connected to the outer peripheries of the mounting portion 343*a* and the shell body 371 by compression-bonding.

Moreover, in the state in which the terminal housing 34 and the shield shell 37 are assembled, the fixing portions 343*b* of the insert plate 343 and the protrusions 372 of the shell body 371 are overlapped, whereby the fixing holes 363*c* communicate with the fixing holes 372*a*, hence, as shown in FIG. 18, the electric wires 10 can be fixed to the holding member 98 of the counterpart connection device using the fixing members (bolts or the like) 99 inserted into the fixing holes 343*c* and 372*a*.

Still further, a mounting groove 34*a* on which the housing packing 16 is mounted is formed in the terminal housing 34. The housing packing 16 is mounted in this mounting groove 34*a* to seal between the front portion (the fitting inlet for the terminals 33 formed in the holding member 98 shown in FIGS. 16 to 18) of the counterpart connection device and the housing body 341, whereby water intrusion into the section where the electric wires 10 are connected to the terminals is prevented. In this case, in the mounting groove 34*a*, a fit-in portion 34*b* into which the rotation prevention piece 16*a* of the housing packing 16 is fitted so as to interfere therewith is formed, whereby the housing packing 16 is prevented from rotating with respect to the terminal housing 34 as in the case of the first embodiment.

Moreover, the two terminals 33 according to this embodiment are respectively connected to the two terminal base terminals 91 provided on the terminal base 90 (see FIGS. 5, 6A and 6B) and are electrically connected to the counterpart connection device via the terminal base 90 as in the case of the first embodiment. Consequently, also in this embodiment, the terminal base 90 in which the terminal base terminals 91 and the spring parts 93 are assembled and integrated with the terminal base housing 92 can be connected to the electric wires 10. Furthermore, the contact portions 912 of the terminal base terminals 91 connected to the terminals 13 are connected to the electric wires, bus bar or the like of the counterpart connection device using the nuts 94, whereby the electric wires 10 are set in a state of being able to be electrically connected to the counterpart connection device at the terminal base 90.

As described above, with the connection structures according to the second embodiment and the third embodiment, as in the case of the first embodiment described above, the size of the section where the electric wires are connected to the terminals can be reduced and the work for connecting the the electric wires 10 to the terminals can be improved. Still further, the size of the terminal connection section of the counterpart connection device can also be reduced, whereby the size of the section where the electric wires 10 are connected to the terminals can be further reduced.

The features of the multiple wire terminal connection structure according to the embodiments of the present invention described above will be briefly summarized and listed in the following [1] to [4].

[1] A multiple wire terminal connection structure for a plurality of electric wires (10), each having a core wire (11) coated with an insulation coating (12), and a plurality of terminals (13) to be connected to the electric wires respectively.

wherein each of the terminals has a connection portion (131) to be connected to a portion from which the insulation coating is stripped off such that the core wire is exposed and an extension portion (132) extending from the connection portion and to be connected to a terminal member of a counterpart connection device, and wherein the extension portions are each formed to have a cross section of an arc shape and are arranged such that the cross sections of the extension portions are arranged in a substantially circular manner and such that the extension portions are spaced from each other in a circumferential direction.

[2] The multiple wire terminal connection structure according to [1] described above, further including a plurality of spring parts (93) configured to contact the extension portions and the terminal members such that the extension portions and the terminal members are electrically connected to each other, wherein the plurality of spring parts are each extended to have a cross section of an arc shape and are arranged such that the cross sections of the spring parts are arranged in a substantially circular manner and such that the spring parts are spaced from each other in the circumferential direction.

[3] The multiple wire terminal connection structure according to [1] or [2] described above, wherein the terminals are arranged such that axial centers of the arc shapes of the extension portions extend along a direction intersecting a direction of the electric wires extend.

[4] The multiple wire terminal connection structure according to [1] described above, further including a sealing member (35) configured to hermetically enclose the terminals from the outside, wherein the sealing member has a bottom part (35*a*) and a lid part (35*b*) that are arranged in front and back in the intersecting direction, and the bottom part and the lid part are assembled together to form a unitary body.

While the present invention has been described in detail with reference to certain embodiments thereof, those skilled in the art will understand that various changes and modifications may be made therein without departing from the spirit and scope of the present invention.

With the present invention, the size of the section where the plurality of electric wires are connected to the terminals can be reduced. The present invention exhibiting this advantage is useful for a terminal connection structure for a plurality of electric wires, the core wires of which are each coated with an insulation coating.

What is claimed is:

1. A multiple wire terminal connection structure for a plurality of electric wires, each having a core wire coated with an insulation coating, the structure comprising:

a plurality of terminals to be connected to the electric wires, respectively, wherein each of the terminals comprises:

a connection portion configured to be connected to a portion of a corresponding one of the electric wires from which the insulation coating is stripped off such that the core wire is exposed, and an extension portion extending from the connection portion in an extension direction and to be connected to a terminal member of a counterpart connection device, and wherein the extension portions are each formed to have a cross section, in a direction perpendicular to the extension direction of the extension portion, of an arc shape and are arranged such that the cross sections of the extension portions are arranged in a substantially circular manner and such that the extension portions are spaced from each other in a circumferential direction, the circumferential direction being perpendicular to the extension direction.

2. The multiple wire terminal connection structure according to claim 1, further comprising a plurality of spring parts configured to contact the extension portions and the terminal members such that the extension portions and the terminal members are electrically connected to each other, wherein the plurality of spring parts are each extended to have a cross section of an arc shape and are arranged such that the cross sections of the spring parts are arranged in a substantially circular manner and such that the spring parts are spaced from each other in the circumferential direction, and wherein the plurality of spring parts are elastically deformable independently of the extension portions of the plurality of terminals.

3. The multiple wire terminal connection structure according to claim 1, wherein the terminals are arranged such that axial centers of the arc shapes of the extension portions extend along a direction intersecting a direction of the electric wires extend.

4. The multiple wire terminal connection structure according to claim 3, further including a sealing member configured to hermetically enclose the terminals from an outside, wherein the sealing member comprises a bottom part and a lid part that are arranged in front and back in the intersecting direction, and the bottom part and the lid part are assembled together to form a unitary body.

* * * * *